US010392821B2

(12) United States Patent
Volin

(10) Patent No.: US 10,392,821 B2
(45) Date of Patent: Aug. 27, 2019

(54) FOUR-DEVICE-IN-ONE SPLASH-AND-DRIP-ELIMINATING GAZEBO, COMPRISING SELF-VENTILATING ANTI-MOSQUITO TOP-ROOF SYSTEM, SPLASH-DRIP-ELIMINATING BOTTOM-ROOF SYSTEM, LEAF-FILTERING GUTTER-SPOUT POST SYSTEM, MULTI-PURPOSE MULTI-CONFIGURATION PANEL SYSTEM, AND HEIGHT-ADJUSTABLE BASE SYSTEM

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 0 days.

(21) Appl. No.: 16/149,154

(22) Filed: Oct. 2, 2018

(65) Prior Publication Data

US 2019/0100933 A1 Apr. 4, 2019

Related U.S. Application Data

(60) Provisional application No. 62/567,418, filed on Oct. 3, 2017.

(51) Int. Cl.
*E04H 1/12* (2006.01)
*E04B 1/19* (2006.01)
(Continued)

(52) U.S. Cl.
CPC ..... *E04H 1/1205* (2013.01); *E04B 1/19* (2013.01); *E04B 7/026* (2013.01);
(Continued)

(58) Field of Classification Search
CPC ... E04H 1/1205; E04H 1/1211; E04H 1/1216; E04H 1/1222; E04H 1/1233;
(Continued)

(56) References Cited

U.S. PATENT DOCUMENTS 3,807,101 A * 4/1974 Cole ..... E04B 1/26 52/11
4,332,116 A * 6/1982 Buchanan ..... E04B 1/24 52/126.6
(Continued)

FOREIGN PATENT DOCUMENTS

DE 19932847 A1 * 3/2000 ..... E04B 7/028
EP 0828042 A1 * 3/1998 ..... E04H 1/1205
(Continued)

*Primary Examiner* — Christine T Cajilig

(57) ABSTRACT

A four-device-in-one splash-and-drip-eliminating gazebo comprising: a top roof, top-roof columns, top-roof mosquito-mesh panels respectively screwed to the top-roof columns, a bottom roof, respectively screwed to the top-roof columns, rain-water gutters molded to the rain-water gutters as one unit for functioning as gutters and top rails at the same time for collecting rain water to be used for irrigation, splash-drip-eliminating eaves respectively formed at the bottom-roof end of the bottom roof for extending downward into the gutter inside to direct water downward into the gutter inside to eliminate water splash and water drip and for collecting rain water to be used for irrigation, top rails molded to the rain-water gutters as one unit for functioning as gutters and top rails at the same time, the bottom roof screwed to the rain-water gutters and the top rails, corner posts, respectively attached to the rain-water gutters and the top rails, double-U-shaped-end covers respectively slidably coupled with the corner posts for allowing the installation of electrical components on the corner-post inside and for allowing the supply of electricity to the four-device-in-one splash-and-drip-eliminating gazebo from the corner-post inside and for removably covering and protecting electrical components on the corner-post inside, post-locking top-rail slots respectively molded into the top rails for lockably fastening the corner posts to the top rails and for automati-
(Continued)

cally guiding the corner posts into the post-locking top-rail slots, top-rail-locking post slots respectively molded into the corner posts for lockably fastening the corner posts to the top rails and for automatically guiding the top rails into the top-rail-locking post slots to make assembly easier, bottom rails, multi-purpose door frames slidably placed between the top rails and the bottom rails, panels respectively secured to the multi-purpose door frames, H-shaped panel strips respectively secured between the panels, an inner post insertably screwed to the corner posts, a base welded to the inner post, base holes, height-adjustable tube-screws respectively and securably screwed into the base holes for adjusting the height of the corner posts to compensate for uneven terrain and uneven concrete surface and uneven deck surface and for leveling the four-device-in-one splash-and-drip-eliminating gazebo to keep water drainage working properly, anchoring-screw holes respectively molded into the height-adjustable tube-screws, and anchoring screws respectively screwed into the anchoring-screw holes in the height-adjustable tube-screws for securing and strengthening the triangular base and the four-device-in-one splash-and-drip-eliminating gazebo to the ground.

20 Claims, 34 Drawing Sheets

(51) Int. Cl.

| | |
|---|---|
| ***E04B 7/02*** | (2006.01) |
| ***E04D 13/08*** | (2006.01) |
| ***E04D 13/064*** | (2006.01) |
| ***E04D 13/076*** | (2006.01) |

(52) U.S. Cl.
CPC ..... *E04D 13/0643* (2013.01); *E04D 13/0767* (2013.01); *E04D 2013/0826* (2013.01)

(58) Field of Classification Search
CPC ..... E04H 1/1238; E04H 1/1244; E04B 1/19; E04B 7/028; E04D 13/0643
See application file for complete search history.

(56) References Cited

U.S. PATENT DOCUMENTS

| | | | | |
|---|---|---|---|---|
| 6,349,511 | B1 | 2/2002 | McAlpin | |
| D458,689 | S | 6/2002 | Wang | |
| D483,498 | S | 12/2003 | Wang | |
| D502,776 | S | 3/2005 | Wang | |
| D505,731 | S | 5/2005 | Wang | |
| D506,836 | S | 6/2005 | Wang | |
| D509,908 | S | 9/2005 | Wang | |
| D532,116 | S | 11/2006 | Merritt | |
| 7,207,344 | B2 | 4/2007 | Wu | |
| 7,308,901 | B2 | 12/2007 | Meyer | |
| D594,134 | S | 6/2009 | Giovino | |
| 7,963,072 | B2 * | 6/2011 | Anderson | E04H 1/12 52/639 |
| D659,258 | S | 5/2012 | Wang | |
| 8,286,591 | B2 | 10/2012 | Moffett-Chaney | |
| 8,640,420 | B1 | 2/2014 | Halley | |
| 9,206,595 | B2 * | 12/2015 | Rutledge | E04B 1/34315 |
| 9,243,422 | B2 | 1/2016 | Hunt | |
| 9,556,639 | B2 | 1/2017 | Hunt | |
| 2006/0266401 | A1 | 11/2006 | Wu | |
| 2010/0162635 | A1 * | 7/2010 | Kopp | E04B 7/028 52/79.4 |
| 2015/0144169 | A1 | 5/2015 | Hunt | |
| 2015/0144170 | A1 | 5/2015 | Hunt | |

FOREIGN PATENT DOCUMENTS

| | | | | |
|---|---|---|---|---|
| GB | 2052591 A | * | 1/1981 | E04B 7/028 |
| WO | WO-2009084099 A1 | * | 7/2009 | E04B 1/34321 |

* cited by examiner

FOUR-DEVICE-IN-ONE SPLASH-AND-DRIP-ELIMINATING GAZEBO, COMPRISING SELF-VENTILATING ANTI-MOSQUITO TOP-ROOF SYSTEM, SPLASH-DRIP-ELIMINATING BOTTOM-ROOF SYSTEM, LEAF-FILTERING GUTTER-SPOUT POST SYSTEM, MULTI-PURPOSE MULTI-CONFIGURATION PANEL SYSTEM, AND HEIGHT-ADJUSTABLE BASE SYSTEM

1) FIELD OF THE INVENTION

The present invention relates to a gazebo, which is economical to produce, is easy to ship as one unit, requires no tools, and can be quickly and easily folded and unfolded. Particularly, the present invention relates to a four-device-in-one splash-and-drip-eliminating gazebo, comprising:

1) Self-ventilating anti-mosquito top-roof system,
2) Splash-drip-eliminating bottom-roof system,
3) Leaf-filtering gutter-spout post system
4) Multi-purpose multi-configuration panel system, and
5) Height-adjustable base system.

2) DESCRIPTION OF THE PRIOR ART

A variety of inventions of gazebos have been introduced.

U.S. Pat. No. 6,349,511, issued 2002 Feb. 26, to Patrick K. McAlpin, demonstrates a gazebo which is fabricated utilizing a novel construction system wherein lightweight aluminum framing components are employed. A preferred structure has eight sides wherein each side includes a pair of vertical posts, a pair of header members, a rail and foot member, columns disposed between the rail and foot member and the pair of header members, and an insulated composite roof panel. An entrance way is void of the rail and foot member, but can be employed with the necessary framing components to attach a door. As each side unit is attached by self mating beam and vertical post members to an adjacent side unit, the gazebo structure is formed. A crown portion can be attached upon an apex of the gazebo.

U.S. Pat. No. 7,207,344, issued 2007 Apr. 24, to Chung Sen Wu, describes a two-tier canopy system which is provided that includes a canopy support structure having a central post and a plurality of radially extending arms. A first canopy covering is supported by the radially extending arms and has a central opening, wherein the central post extends through the central opening. A second canopy covering, having at least a portion thereof disposed above the central opening, is supported by the central post, wherein the central post is biased towards the second canopy covering.

U.S. Pat. No. 7,308,901, issued 2007 Dec. 18, to Ted H. Meyer, describes a canopy system which includes a canopy frame and a canopy cover supported by the canopy frame. The canopy cover includes an inner solid portion, an outer solid portion, and a meshed portion disposed between the inner and outer solid portions and disposed proximately to an outer periphery of the canopy cover.

U.S. Pat. No. 7,963,072, issued 2011 Jun. 21, to Torrence Anderson, details a system or kit of injection molded panels and other components having integrated connectors which combine together to form an enclosure, preferably in the form of a gazebo. The support posts, roof rafters, roof supports, roof panels and walls are formed of injection molded plastic to interlock with one another without the need for separate I-beam connectors. The system incorporates a minimum number of components to construct a gazebo type enclosure by integrally forming connectors in to the injection molded components and panels.

U.S. Pat. No. 8,286,591, issued 2012 Oct. 16, to Casey Moffett-Chaney, details assemblies that allow pet access through a panel and enclosures having multiple functions. More specifically the enclosures include pet doors that allow for selective entry, whereby one or more designated animals are allowed to enter into the enclosures while other non-designated animals can be easily excluded, without owner supervision. The enclosures herein are useful for multiple purposes, non-exclusively including the isolation of pets so they can eat, eliminate waste, whelp, queen, nurse their young, or sleep without being bothered by other non-designated pets.

U.S. Pat. No. 8,640,420, issued 2014 Feb. 4, to Bradford Halley, describes a pergola system which includes a frame having a plurality of generally vertically-oriented, spaced-apart posts aligned in rows. A generally horizontally-oriented, spaced-apart frame member is attached to each row of posts. A plurality of rails and outer rails extend across the frame members and are oriented generally orthogonally to the frame members, the rails being attached to the frame members.

U.S. Pat. No. 9,243,422, issued 2016 Jan. 26, to David Lewis Hunt, demonstrates a portable shelter framing system which includes a plurality of vertical support members; a plurality of crossbeam members, each of the crossbeam members configured to be connected between a pair of the plurality of vertical support members without the use of tools; and a plurality of roof frame members, each of the roof frame members configured to be coupled to one of the plurality of vertical support members or one of the plurality of crossbeam members without the use of tools.

U.S. Pat. No. 9,556,639, issued 2017 Jan. 31, to David Lewis Hunt, details a portable shelter framing system which includes a plurality of corner support members; a plurality of crossbeam members, each of the crossbeam members configured to be connected between a pair of the plurality of corner support members without the use of tools; and a plurality of roof frame members, each of the roof frame members configured to be coupled to one of the plurality of corner support members or one of the plurality of crossbeam members without the use of tools.

U.S. Pat. No. D458,689, issued 2002 Jun. 11, to Leo Chi-Hong Wang, demonstrates an ornamental design for a two tier gazebo.

U.S. Pat. No. D483,498, issued 2003 Dec. 9, to Leo Chi-Hong Wang, details an ornamental design for a two tier gazebo.

U.S. Pat. No. D502,776, issued 2005 Mar. 8, to Leo Chi-Hong Wang, details an ornamental design for a simple roof greek key design barzebo.

U.S. Pat. No. D505,731, issued 2005 Mar. 31, to Leo Chi-Hong Wang, demonstrates an ornamental design for a Greek key design barzebo with overhang.

U.S. Pat. No. D506,836, issued 2005 Jun. 28, to Leo Chi-Hong Wang, describes an ornamental design for a victorian design barzebo with overhang.

U.S. Pat. No. D509,908, issued 2005 Sep. 20, to Leo Chi-Hong Wang, describes an ornamental design for a simple roof palm design barzebo.

U.S. Pat. No. D532,116, issued 2006 Nov. 14, to Ronald R. Merritt, details an ornamental design for a gazebo.

U.S. Pat. No. D594,134, issued 2009 Jun. 9, to Christopher J. Giovino, details an ornamental design for a three panel corner grouping for a gazebo.

U.S. Pat. No. D659,258, issued 2012 May 8, to Leo Chi-Hong Wang, demonstrates an ornamental design for a gazebo.

U.S. Patent No 20060266401, issued 2006 Nov. 30, to Weidan Wu, demonstrates a tarpaulin shelter with collapsible doorframes, it includes doorframes, the lower end of which is connected to the base and the upper end is connected with corner joint and cross beam, characterized in that the doorframe includes at least three upright poles, in which at least a set of x-scissor member are arranged between the middle upright pole and each side upright pole, said scissor is composed of two cross rods of which the middle portions are mutually hinged together. One end of each cross rod is hinged with the fixing collar of the corresponding upright pole; the other end is hinged with the movable collar corresponding to upright pole.

U.S. Patent No 20150144169, issued 2015 May 28, to David Lewis Hunt, describes a portable shelter framing system which includes a plurality of corner support members; a plurality of crossbeam members, each of the crossbeam members configured to be connected between a pair of the plurality of corner support members without the use of tools; and a plurality of roof frame members, each of the roof frame members configured to be coupled to one of the plurality of corner support members or one of the plurality of crossbeam members without the use of tools.

U.S. Patent No 20150144170, issued 2015 May 28, to David Lewis Hunt, demonstrates a portable shelter framing system which includes a plurality of vertical support members; a plurality of crossbeam members, each of the crossbeam members configured to be connected between a pair of the plurality of vertical support members without the use of tools; and a plurality of roof frame members, each of the roof frame members configured to be coupled to one of the plurality of vertical support members or one of the plurality of crossbeam members without the use of tools.

Disadvantages of the Prior Art

The prior art have failed to solve many problems associated with such gazebos as follows:

1) No prior art mention or disclose any gazebo, having height-adjustable tube-screws 132 and anchoring screws 134.
   Therefore, the prior art of gazebo:
   a) Can not securably insert into anchoring-screw holes 133
      to provide vertical adjustability
      (see FIGS. 2A and 9);
   b) Can not adjust the height of corner posts 116*a*
      to compensate for uneven terrain
      (see FIGS. 2A and 9);
   c) Can not adjust the height of corner posts 116*a*
      to compensate for uneven concrete surface
      (see FIGS. 2A and 9);
   d) Can not adjust the height of corner posts 116*a*
      to compensate for uneven deck surface
      (see FIGS. 2A and 9); and
   e) Can not level the gazebo
      to keep water drainage working properly
      (see FIGS. 2A and 9).
2) No prior art mention or disclose any gazebo, having multi-purpose panel frames 121.
   Therefore, the prior art of gazebo:
   a) Can not securably hold screen material first panels 122, screen material second panels 123, and H-shaped panel strips 124
      to allow wind to flow through
      (see FIG. 8I);
   b) Can not securably hold transparent material first panels 122, transparent material second panels 123, and H-shaped panel strips 124
      to provide light to shine through
      (see FIGS. 8A, 8B, 8C, 8D, 8E, 8F, 8G, 8J, and 8K);
   c) Can not securably hold opaque material first panels 122, opaque material second panels 123, and H-shaped panel strips 124
      to block wind or light
      (see FIG. 8H); and
   d) Can not allow quick and easy installation of door panels
      to provide numerous door configuration options
      (see FIGS. 8A, 8B, 8C, 8D, 8E, 8F, 8G, 8H, 8I, 8J, and 8K).
3) No prior art mention or disclose any gazebo, having first panels 122.
   Therefore, the prior art of gazebo:
   a) Can not allow wind to flow through when made with mesh material
      to cool occupants
      (see FIG. 8I);
   b) Can not provide light to shine through when made with transparent material
      to provide light to occupants
      (see FIGS. 8A, 8B, 8C, 8D, 8E, 8F, 8G, 8J, and 8K); and
   c) Can not block wind or light when made with solid material
      to provide cooling and light to occupants
      (see FIG. 8H).
4) No prior art mention or disclose any pet crate, having second panels 123.
   Therefore, the prior art of pet crate:
   a) Can not allow wind to flow through when made with mesh material
      to cool occupants
      (see FIG. 8I);
   b) Can not provide light to shine though when made with transparent material
      to provide light to occupants
      (see FIGS. 8A, 8B, 8C, 8D, 8E, 8F, 8G, 8J, and 8K); and
   c) Can not block wind or light when made with solid material
      to provide cooling and light to occupants
      (see FIGS. 1A and 8H).
5) No prior art mention or disclose any gazebo, having splash-drip-eliminating eaves 107.
   Therefore, the prior art of gazebo:
   a) Can not extend downward into the inside of rain-water gutters 109 and
      Can not direct water downward into the inside of rain-water gutters 109
      in the directions of arrows 136*b* and 136*c*
      to eliminate water splash and water drip
      (see FIGS. 7F, 7G, 8G, and 8M);
   a) Can not collect rain water
      to be used for irrigation
      (see FIGS. 7F, 7G, 8G, and 8M); and
   b) Can not protect occupants from getting wet
      to keep them dry and safe
      (see FIGS. 7F, 7G, 8G, and 8M).

6) No prior art mention or disclose any gazebo, having rain-water gutters 109 and
top rails 114 extrudedly manufactured as one unit to reinforce one another and to function as gutters and top rails at the same time.
Therefore, the prior art of gazebo:
a) Can not direct water into rain-water drain holes 110 in the directions of arrows 137*a* and 137*b* to direct water away from gazebo (see FIGS. 7E, 7F, 7G, and 7H);
b) Can not collect rain water to be used for irrigation (see FIGS. 7E, 7F, 7G, and 7H); and
c) Can not direct water away from occupants to keep them dry and safe (see FIGS. 7E, 7F, 7G, and 7H).

7) No prior art mention or disclose any gazebo, having rain-water drain holes 110.
Therefore, the prior art of gazebo:
a) Can not prevent leaves or other debris from getting into leaf-filtering tubes 111 to keep leaf-filtering tubes 111 free from clogs (see FIGS. 7A, 7C, 7D, 7E, 7G, and 7H);
b) Can not prevent small birds or animals from entering or nesting inside leaf-filtering tubes 111 to keep leaf-filtering tubes 111 free from clogs (see FIGS. 7A, 7C, 7D, 7E, 7G, and 7H); and
c) Can not collect rain water to be used for irrigation (see FIGS. 7A, 7C, 7D, 7E, 7G, and 7H).

8) No prior art mention or disclose any gazebo, having leaf-filtering tubes 111 and rain-water-draining spouts 112 hidden inside corner posts 116*a*.
Therefore, the prior art of gazebo:
a) Can not filter leaves and draining water from inside corner posts 116*a* in the directions of arrows 136*c* and 137*b* to separate the leaves from the water (see FIGS. 7G and 7H);
b) Can not direct water quickly and safely away from the gazebo from inside corner posts 116*a* to prevent rusting and wear in the directions of arrows 136*c* and 137*b* (see FIGS. 7G and 7H); and
c) Can not directing water quickly and safely away from occupants from inside corner posts 116*a* to keep them safe and dry in the directions of arrows 136*c* and 137*b* (see FIGS. 7G and 7H).

9) No prior art mention or disclose any gazebo, having Post-locking top-rail slots 115.
Therefore, the prior art of gazebo:
a) Can not securely fasten corner posts 116*a* to top rails 114 to keep gazebo from coming apart and injuring occupants (see FIGS. 7A, 7D, and 7E);
b) Can not automatically guide corner posts 116*a* easily into top-rail-locking post slots 117 to make assembly easier (see FIGS. 7A, 7D, and 7E); and
c) Can not keep corner posts 116*a* plumb to prevent gazebo from twisting (see FIGS. 7A, 7D, and 7E).

10) No prior art mention or disclose any gazebo, having top-rail-locking post slots 117.
Therefore, the prior art of gazebo:
a) Can not securely fasten top rails 114 to corner posts 116*a* to prevent the gazebo from collapsing (see FIGS. 7B, 7C, and 7F);
b) Can not automatically guide corner posts 116*a* easily into post-locking top-rail slots 115 to make assembly easier (see FIGS. 7A, 7D, and 7E); and
c) Can not keeping corner posts 116*a* plumb to prevent gazebo from twisting (see FIGS. 7A, 7D, and 7E).

11) No prior art mention or disclose any gazebo, having double-U-shaped-end covers 116*b*.
Therefore, the prior art of gazebo:
a) Can not slide on and off corner posts 116*a* to allow access to the inside of corner posts 116*a* (see FIGS. 11A, 11B, 11C, 11D, 11E, and 11F);
b) Can not slide on and off corner posts 116*a* to allow the installation of electrical connection box 140 on the inside of corner posts 116*a* (see FIGS. 11A, 11B, 11C, 11D, 11E, and 11F); and
c) Can not slide on and off corner posts 116*a* to integrate an external electrical source 141 on the inside of corner posts 116*a* to supply electricity to the four-device-in-one splash-and-drip-eliminating gazebo from the inside of corner posts 116*a* (see FIGS. 11A, 11B, 11C, 11D, 11E, and 11F).

Objects and Advantages of the Invention

The present invention substantially departs from the conventional concepts and designs of the prior art. In doing so, the present invention provides a four-device-in-one splash-and-drip-eliminating gazebo (comprising: a) Self-ventilating anti-mosquito top-roof system, b) Splash-drip-eliminating bottom-roof system, c) Leaf-filtering gutter-spout post system, d) Multi-purpose multi-configuration panel system, and e) Height-adjustable base system), having many new and significant features, functions, and advantages, which overcome all the disadvantages of the prior art, as follows:

1) It is an object of the new invention to provide a four-device-in-one splash-and-drip-eliminating gazebo, having
height-adjustable tube-screws 132 and
anchoring screws 134.
Therefore, the four-device-in-one splash-and-drip-eliminating gazebo:
a) Can securably insert into anchoring-screw holes 133 to provide vertical adjustability (see FIGS. 2A and 9);
b) Can adjust the height of corner posts 116*a* to compensate for uneven terrain (see FIGS. 2A and 9);
c) Can adjust the height of corner posts 116*a* to compensate for uneven concrete surface (see FIGS. 2A and 9);
d) Can adjust the height of corner posts 116*a* to compensate for uneven deck surface (see FIGS. 2A and 9); and
e) Can level the gazebo to keep water drainage working properly (see FIGS. 2A and 9).

2) It is another object of the new invention to provide a four-device-in-one splash-and-drip-eliminating gazebo, having
multi-purpose panel frames 121.
Therefore, the four-device-in-one splash-and-drip-eliminating gazebo:
a) Can securably hold screen material first panels 122, screen material second panels 123, and H-shaped panel strips 124
to allow wind to flow through
(see FIG. 8I);
b) Can securably hold transparent material first panels 122, transparent material second panels 123, and H-shaped panel strips 124
to provide light to shine through
(see FIGS. 8A, 8B, 8C, 8D, 8E, 8F, 8G, 8J, and 8K);
c) Can securably hold opaque material first panels 122, opaque material second panels 123, and H-shaped panel strips 124
to block wind or light
(see FIG. 8H); and
e) Can allow quick and easy installation of door panels
to provide numerous door configuration options
(see FIGS. 8A, 8B, 8C, 8D, 8E, 8F, 8G, 8H, 8I, 8J, and 8K).

3) It is another object of the new invention to provide a four-device-in-one splash-and-drip-eliminating gazebo, having
first panels 122.
Therefore, the four-device-in-one splash-and-drip-eliminating gazebo:
a) Can allow wind to flow through when made with mesh material
to cool occupants
(see FIG. 8I);
b) Can provide light to shine through when made with transparent material
to provide light to occupants
(see FIGS. 8A, 8B, 8C, 8D, 8E, 8F, 8G, 8J, and 8K); and
c) Can block wind or light when made with solid material
to provide cooling and light to occupants
(see FIG. 8H).

4) It is a further object of the new invention to provide a four-device-in-one splash-and-drip-eliminating gazebo, having
second panels 123.
Therefore, the four-device-in-one splash-and-drip-eliminating gazebo:
a) Can allow wind to flow through when made with mesh material
to cool occupants
(see FIG. 8I);
b) Can provide light to shine though when made with transparent material
to provide light to occupants
(see FIGS. 8A, 8B, 8C, 8D, 8E, 8F, 8G, 8J, and 8K); and
c) Can block wind or light when made with solid material
to provide cooling and light to occupants
(see FIGS. 1A and 8H).

5) It is an even further object of the new invention to provide a four-device-in-one splash-and-drip-eliminating gazebo, having
splash-drip-eliminating eaves 107.
Therefore, the four-device-in-one splash-and-drip-eliminating gazebo:
b) Can extend downward into the inside of rain-water gutters 109 and
Can direct water downward into the inside of rain-water gutters 109
in the directions of arrows 136*b* and 136*c*
to eliminate water splash and water drip
(see FIGS. 7F, 7G, 8G, and 8M);
c) Can collect rain water
to be used for irrigation
(see FIGS. 7F, 7G, 8G, and 8M); and
d) Can protect occupants from getting wet
to keep them dry and safe
(see FIGS. 7F, 7G, 8G, and 8M).

6) It is another object of the new invention to provide a four-device-in-one splash-and-drip-eliminating gazebo, having
rain-water gutters 109 and
top rails 114 extrudedly manufactured as one unit to reinforce one another and to function as gutters and top rails at the same time.
Therefore, the four-device-in-one splash-and-drip-eliminating gazebo:
a) Can direct water into rain-water drain holes 110
in the directions of arrows 137*a* and 137*b*
to direct water away from gazebo
(see FIGS. 7E, 7F, 7G, and 7H);
b) Can collect rain water
to be used for irrigation
(see FIGS. 7E, 7F, 7G, and 7H); and
c) Can direct water away from occupants
to keep them dry and safe
(see FIGS. 7E, 7F, 7G, and 7H).

7) It is yet another object of the new invention to provide a four-device-in-one splash-and-drip-eliminating gazebo, having
rain-water drain holes 110.
Therefore, the four-device-in-one splash-and-drip-eliminating gazebo:
a) Can prevent leaves or other debris from getting into leaf-filtering tubes 111
to keep leaf-filtering tubes 111 free from clogs
(see FIGS. 7A, 7C, 7D, 7E, 7G, and 7H);
b) Can prevent small birds or animals from entering or nesting inside leaf-filtering tubes 111
to keep leaf-filtering tubes 111 free from clogs
(see FIGS. 7A, 7C, 7D, 7E, 7G, and 7H); and
c) Can collect rain water
to be used for irrigation
(see FIGS. 7A, 7C, 7D, 7E, 7G, and 7H).

8) It is still yet another object of the new invention to provide a four-device-in-one splash-and-drip-eliminating gazebo, having
leaf-filtering tubes 111 and rain-water-draining spouts 112 hidden inside corner posts 116*a*.
Therefore, the four-device-in-one splash-and-drip-eliminating gazebo:
a) Can filter leaves and draining water from inside corner posts 116*a*
in the directions of arrows 136*c* and 137*b*
to separate the leaves from the water
(see FIGS. 7G and 7H);
b) Can direct water quickly and safely away from the gazebo from inside corner posts 116*a*
to prevent rusting and wear
in the directions of arrows 136*c* and 137*b*
(see FIGS. 7G and 7H); and c) Can directing water quickly and safely away from occupants from inside corner posts 116*a*
to keep them safe and dry
in the directions of arrows 136*c* and 137*b*
(see FIGS. 7G and 7H).

9) It is still yet another object of the new invention to provide a four-device-in-one splash-and-drip-eliminating gazebo, having
post-locking top-rail slots 115.
Therefore, the four-device-in-one splash-and-drip-eliminating gazebo:
a) Can securely fasten corner posts 116*a* to top rails 114
to keep gazebo from coming apart and injuring occupants
(see FIGS. 7A, 7D, and 7E);
b) Can automatically guide corner posts 116*a* easily into top-rail-locking post slots 117
to make assembly easier
(see FIGS. 7A, 7D, and 7E); and
c) Can keep corner posts 116*a* plumb
to prevent gazebo from twisting
(see FIGS. 7A, 7D, and 7E).

10) It is still yet another object of the new invention to provide a four-device-in-one splash-and-drip-eliminating gazebo, having
top-rail-locking post slots 117.
Therefore, the four-device-in-one splash-and-drip-eliminating gazebo:
a) Can securely fasten top rails 114 to corner posts 116*a*
to prevent the gazebo from collapsing
(see FIGS. 7B, 7C, and 7F);
b) Can automatically guide corner posts 116*a* easily into post-locking top-rail slots 115
to make assembly easier
(see FIGS. 7A, 7D, and 7E); and
c) Can keeping corner posts 116*a* plumb
to prevent gazebo from twisting
(see FIGS. 7A, 7D, and 7E).

11) It is still yet another object of the new invention to provide a four-device-in-one splash-and-drip-eliminating gazebo, having
double-U-shaped-end covers 116*b*.
Therefore, the four-device-in-one splash-and-drip-eliminating gazebo:
a) Can slide on and off corner posts 116*a*
to allow access to the inside of corner posts 116*a*
(see FIGS. 11A, 11B, 11C, 11D, 11E, and 11F);
b) Can slide on and off corner posts 116*a*
to allow the installation of electrical connection box 140
on the inside of corner posts 116*a*
(see FIGS. 11A, 11B, 11C, 11D, 11E, and 11F); and
c) Can slide on and off corner posts 116*a*
to integrate an external electrical source 141
on the inside of corner posts 116*a*
to supply electricity to the four-device-in-one splash-and-drip-eliminating gazebo from the inside of corner posts 116*a*
(see FIGS. 11A, 11B, 11C, 11D, 11E, and 11F).

Other objects and advantages of the present invention will become apparent from a consideration of the accompanying drawings and ensuing description.

BRIEF SUMMARY OF THE INVENTION

A four-device-in-one splash-and-drip-eliminating gazebo comprising: a top roof, top-roof columns, top-roof mosquito-mesh panels respectively screwed to the top-roof columns, a bottom roof, respectively screwed to the top-roof columns, rain-water gutters molded to the rain-water gutters as one unit for functioning as gutters and top rails at the same time for collecting rain water to be used for irrigation, splash-drip-eliminating eaves respectively formed at the bottom-roof end of the bottom roof for extending downward into the gutter inside to direct water downward into the gutter inside to eliminate water splash and water drip and for collecting rain water to be used for irrigation, top rails molded to the rain-water gutters as one unit for functioning as gutters and top rails at the same time, the bottom roof screwed to the rain-water gutters and the top rails, corner posts, respectively attached to the rain-water gutters and the top rails, double-U-shaped-end covers respectively slidably coupled with the corner posts for allowing the installation of electrical components on the corner-post inside and for allowing the supply of electricity to the four-device-in-one splash-and-drip-eliminating gazebo from the corner-post inside and for removably covering and protecting electrical components on the corner-post inside, post-locking top-rail slots respectively molded into the top rails for lockably fastening the corner posts to the top rails and for automatically guiding the corner posts into the post-locking top-rail slots, top-rail-locking post slots respectively molded into the corner posts for lockably fastening the corner posts to the top rails and for automatically guiding the top rails into the top-rail-locking post slots to make assembly easier, bottom rails, multi-purpose door frames slidably placed between the top rails and the bottom rails, panels respectively secured to the multi-purpose door frames, H-shaped panel strips respectively secured between the panels, an inner post insertably screwed to the corner posts, a base welded to the inner post, base holes, height-adjustable tube-screws respectively and securably screwed into the base holes for adjusting the height of the corner posts to compensate for uneven terrain and uneven concrete surface and uneven deck surface and for leveling the four-device-in-one splash-and-drip-eliminating gazebo to keep water drainage working properly, anchoring-screw holes respectively molded into the height-adjustable tube-screws, and anchoring screws respectively screwed into the anchoring-screw holes in the height-adjustable tube-screws for securing and strengthening the triangular base and the four-device-in-one splash-and-drip-eliminating gazebo to the ground.

DETAILED DESCRIPTION OF THE INVENTION

Component

Figure 1A:
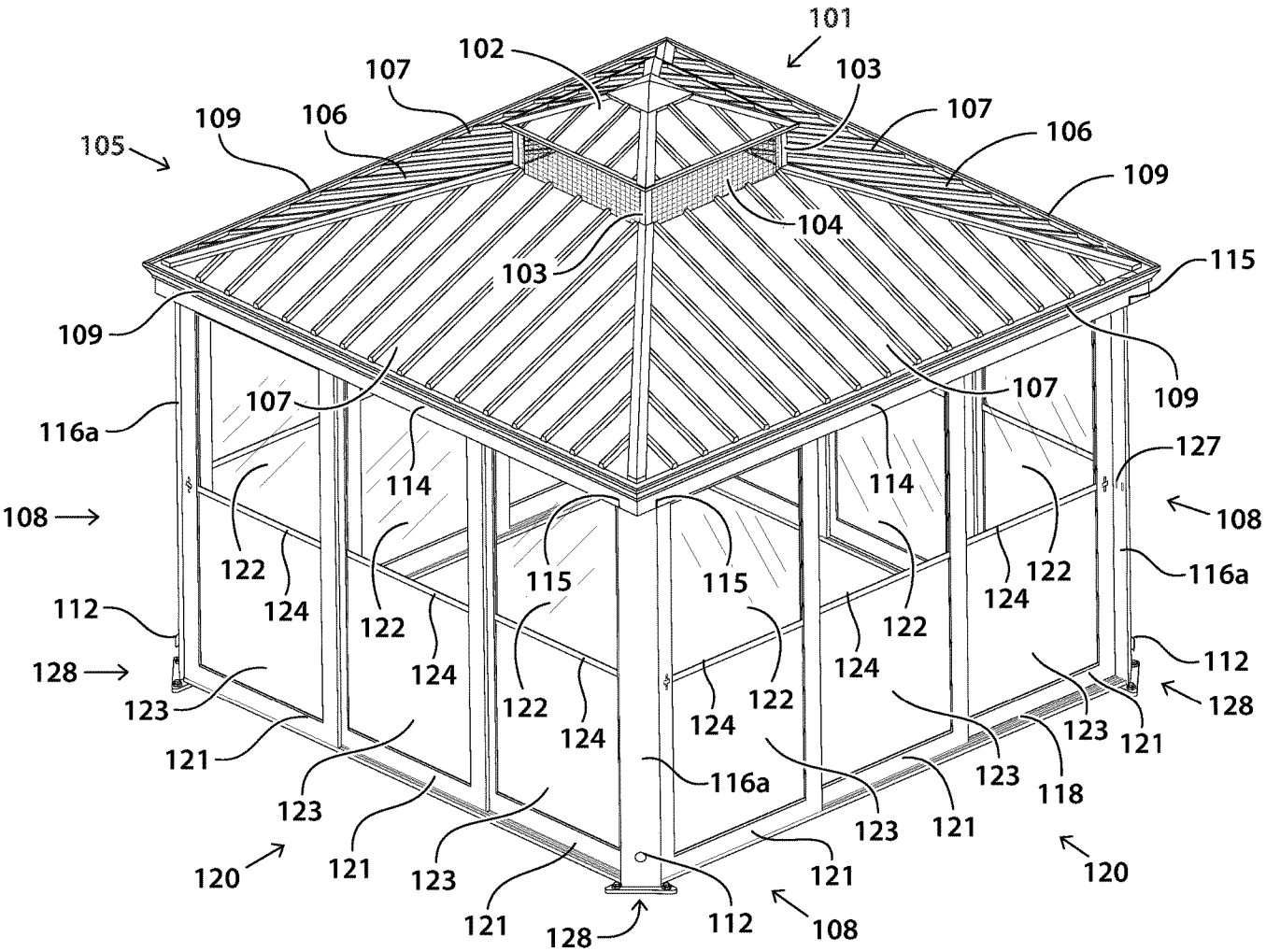
FIGS. 1A and 1B illustrate top perspective and front views of a four-device-in-one splash-and-drip-eliminating gazebo.
Figure 1B:
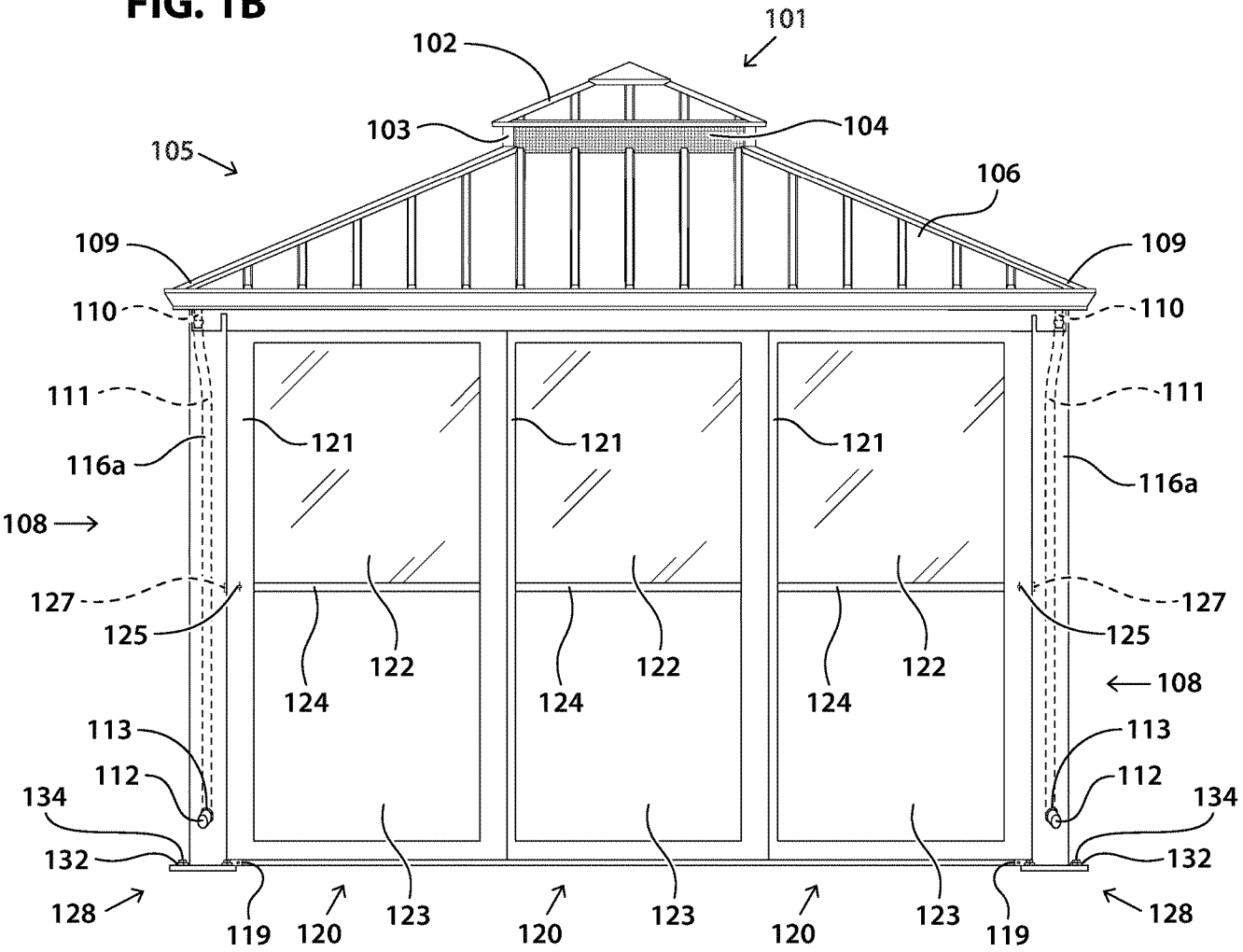

The four-device-in-one splash-and-drip-eliminating gazebo comprises:

1) Self-ventilating anti-mosquito top-roof system,
2) Splash-drip-eliminating bottom-roof system,
3) Leaf-filtering gutter-spout post system
4) Multi-purpose multi-configuration panel system, and
5) Height-adjustable base system.

Referring to FIGS. 1A, 1B, 2A, 2B, 3A, 3B, 4A, 4B, 5A, and 5B, the four-device-in-one splash-and-drip-eliminating gazebo comprises:

1) Self-ventilating anti-mosquito top-roof system 101, comprising:
2) Top roof 102,
3) Top-roof columns 103, and
4) Top-roof mosquito-mesh panels 104;
5) Splash-drip-eliminating bottom-roof system 105, comprising:
6) Bottom roof 106, and
7) Splash-drip-eliminating eaves 107;
8) Leaf-filtering gutter-spout post system 108, comprising:
9) Rain-water gutters 109,
10) Rain-water drain holes 110,
11) Leaf-filtering tubes 111,
12) Rain-water-draining spouts 112,
13) Rain-water-draining spout holes 113,
14) Top rails 114,
15) Post-locking top-rail slots 115,
16) Corner posts 116*a*,
Double-U-shaped-end covers 116*b*,
17) Top-rail-locking post slots 117,
18) Bottom rails 118, and
19) Bottom-rail brackets 119;
20) Multi-purpose multi-configuration panel system 120, comprising:
21) Multi-purpose door frames 121,
22) First panels 122,
23) Second panels 123,
24) H-shaped panel strips 124,
25) Slide-lock slider grips 125,
26) Slide-lock catches 126, and
27) Slide-lock-catch-locking slots 127;
28) Height-adjustable base system 128, comprising:
29) Inner post 129,
30) Triangular base 130,
31) Base holes 131,
32) Height-adjustable tube-screws 132,
33) Anchoring-screw holes 133, and
34) Anchoring screws 134.

Material

Referring to FIGS. 1A, 1B, 2A, 2B, 3A, 3B, 4A, 4B, 5A, and 5B:

1) Self-ventilating anti-mosquito top-roof system 101 is made of the combined materials of its components.
2) Top roof 102
is made of metallic material.
3) Top-roof columns 103
each are made of metallic material.
4) Top-roof mosquito-mesh panels 104
each are made of plastic material.
5) Splash-drip-eliminating bottom-roof system 105 is made of the combined materials of its components.
6) Bottom roof 106
is made of metallic material.
7) Splash-drip-eliminating eaves 107
each are made of metallic material.
8) Leaf-filtering gutter-spout post system 108 is made of the combined materials of its components.
9) Rain-water gutters 109
each are made of metallic material.
10) Rain-water drain holes 110
each are made of empty space.
11) Leaf-filtering tubes 111
each are made of plastic or rubber material.
12) Rain-water-draining spouts 112
each are made of plastic material.
13) Rain-water-draining spout holes 113
each are made of empty space.
14) Top rails 114
each are made of metallic material.
15) Post-locking top-rail slots 115
each are made of empty space.
16) Corner posts 116*a*
each are made of metallic material.
Double-U-shaped-end covers 116*b*
each are made of metallic material.

17) Top-rail-locking post slots 117
each are made of empty space.
18) Bottom rails 118
each are made of metallic material.
19) Bottom-rail brackets 119
each are made of metallic material.
20) Multi-purpose multi-configuration panel system 120 is made of the combined materials of its components.
21) Multi-purpose door frames 121
each are made of metallic material.
22) First panels 122
each are made of mesh, transparent or solid material.
23) Second panels 123
each are made of mesh, transparent or solid material.
24) H-shaped panel strips 124
each are made of rubber material.
25) Slide-lock slider grips 125
each are made of plastic material.
26) Slide-lock catches 126
each are made of metallic material.
27) Slide-lock-catch-locking slots 127
each are made of empty space.
28) Height-adjustable base system 128 is made of the combined materials of its components.
29) Inner post 129
is made of metallic material.
30) Triangular base 130
is made of metallic material.
31) Base holes 131
each are made of metallic material.
32) Height-adjustable tube-screws 132
each are made of metallic material.
33) Anchoring-screw holes 133
each are made of empty space.
34) Anchoring screws 134
each are made of metallic material.

Shape

Referring to FIGS. 1A, 1B, 2A, 2B, 3A, 3B, 4A, 4B, 5A, and 5B:

1) Self-ventilating anti-mosquito top-roof system 101 is formed into the combined shapes of its components.
2) Top roof 102
has a rectangular shape.
3) Top-roof columns 103
each have an I shape.
4) Top-roof mosquito-mesh panels 104
each have a rectangular shape.
5) Splash-drip-eliminating bottom-roof system 105 is formed into the combined shapes of its components.
6) Bottom roof 106
is formed into a rectangular shape.
7) Splash-drip-eliminating eaves 107
each have a rectangular shape.
8) Leaf-filtering gutter-spout post system 108 is formed into the combined shapes of its components.
9) Rain-water gutters 109
each are formed into a C shape
(extrudedly molded together with top rails 114 to function as one unit).
10) Rain-water drain holes 110
each are formed into a circular shape.
11) Leaf-filtering tubes 111
each are formed into a tubular shape.
12) Rain-water-draining spouts 112
each are formed into a cylindrical shape.
13) Rain-water-draining spout holes 113
each are formed into an oval shape.
14) Top rails 114
each are formed into an E shape
(extrudedly molded together with rain-water gutters 109 to function as one unit).
15) Post-locking top-rail slots 115
each are formed into a rectangular shape.
16) Corner posts 116*a*
each are formed into a triangular shape.
Double-U-shaped-end covers 116*b*
each are formed into a double-U-shaped cross-section.
17) Top-rail-locking post slots 117
each are formed into a rectangular shape.
18) Bottom rails 118
each are formed into a rectangular shape.
19) Bottom-rail brackets 119
each are formed into an L shape.
20) Multi-purpose multi-configuration panel system 120 is formed into the combined shapes of its components.
21) Multi-purpose door frames 121
each are formed into a rectangular shape.
22) First panels 122
each are formed into a rectangular shape.
23) Second panels 123
each are formed into a rectangular shape.
24) H-shaped panel strips 124
each are formed into an H shape.
25) Slide-lock slider grips 125
each are formed into a rectangular shape.
26) Slide-lock catches 126
each are formed into a T shape.
27) Slide-lock-catch-locking slots 127
each are formed into a rectangular shape.
28) Height-adjustable base system 128 is formed into the combined shapes of its components.
29) Inner post 129
is formed into a triangular shape.
30) Triangular base 130
is formed into a triangular shape.
31) Base holes 131
each are formed into a circular shape.
32) Height-adjustable tube-screws 132
each are formed into a screw shape.
33) Anchoring-screw holes 133
each are formed into a circular shape.
34) Anchoring screws 134
each are formed into a screw shape.

Connection

Referring to FIGS. 1A, 1B, 2A, 2B, 3A, 3B, 4A, 4B, 5A, and 5B:

1) Self-ventilating anti-mosquito top-roof system 101 has the combined connections of its components.
2) Top roof 102
is screwed to top-roof columns 103.
3) Top-roof columns 103
respectively are screwed to bottom roof 106.
4) Top-roof mosquito-mesh panels 104
respectively are screwed to top-roof columns 103 and bottom roof 106.
5) Splash-drip-eliminating bottom-roof system 105 has the combined connections of its components.
6) Bottom roof 106
is screwed to corner posts 116*a* and top rails 114.
7) Splash-drip-eliminating eaves 107
respectively are formed at the edge of bottom roof 106.
8) Leaf-filtering gutter-spout post system 108 has the combined connections of its components.

9) Rain-water gutters 109
respectively are extrudedly molded together with top rails 114 as one unit and screwed to corner posts 116*a*.
10) Rain-water drain holes 110
respectively are formed into top rails 114.
11) Leaf-filtering tubes 111
respectively are disposed inside corner posts 116*a* and
respectively are friction-fit to the bottom of rain-water drain holes 110 and to the top of rain-water-draining spouts 112.
12) Rain-water-draining spouts 112
respectively are disposed inside corner posts 116*a* and
respectively are friction-fit to the bottom of leaf-filtering tubes 111.
13) Rain-water-draining spout holes 113
respectively are drilled through corner posts 116*a*.
14) Top rails 114
respectively are extrudedly molded together with rain-water gutters 109 as one unit and inserted into top-rail-locking post slots 117.
15) Post-locking top-rail slots 115
respectively are molded into top rails 114 and
respectively are inserted into top-rail-locking post slots 117.
16) Corner posts 116*a*
respectively are attached to top rails 114.
Double-U-shaped-end covers 116*b*
respectively are slidably coupled with corner posts 116*a*.
17) Top-rail-locking post slots 117
respectively are molded into corner posts 116*a* and
respectively are inserted into Post-locking top-rail slots 115.
18) Bottom rails 118
respectively are screwed into bottom-rail brackets 119.
19) Bottom-rail brackets 119
respectively are screwed into corner posts 116*a*.
20) Multi-purpose multi-configuration panel system 120 has the combined connections of its components.
21) Multi-purpose door frames 121
respectively are slidably placed between top rails 114 and bottom rails 118.
22) First panels 122
respectively are secured to multi-purpose door frames 121.
23) Second panels 123
respectively are secured to multi-purpose door frames 121.
24) H-shaped panel strips 124
respectively are secured between first panels 122 and second panels 123.
25) Slide-lock slider grips 125
respectively are slidably attached to multi-purpose door frames 121.
26) Slide-lock catches 126
respectively are attached to slide-lock slider grips 125.
27) Slide-lock-catch-locking slots 127
respectively are drilled out of multi-purpose door frames 121.
28) Height-adjustable base system 128 has the combined connections of its components.
29) Inner post 129
is insertably screwed to corner posts 116*a*.
30) Triangular base 130
is welded to inner post 129.
31) Base holes 131
respectively are molded into triangular base 130.
32) Height-adjustable tube-screws 132
respectively are screwed into triangular base 130.
33) Anchoring-screw holes 133
respectively are molded into height-adjustable tube-screws 132.
34) Anchoring screws 134
respectively are screwed into anchoring-screw holes 133 in height-adjustable tube-screws 132.

Function

Referring to FIGS. 6A, 6B, 7A, 7B, 7C, 7D, 7E, 7F, 7G, 7H, 8A, 8B, 8C, 8D, 8E, 8F, 8G, 8H, 8I, 8J, 8K, 8L, 8M, 9A, 9B, and 9C:

1) Self-ventilating anti-mosquito top-roof system 101 is for performing the combined functions of its components.
2) Top roof 102 is for:
Protectively shedding water away from the four-device-in-one splash-and-drip-eliminating gazebo
(see FIGS. 6A, 6B, 8G, and 8M).
3) Top-roof columns 103 respectively are for:
Strengthening and supporting top roof 102
(see FIGS. 6A, 6B, and 8M).
4) Top-roof mosquito-mesh panels 104 respectively are for:
Allowing ventilation and wind-flow
in the directions of arrows 135*a*, 135*b*, and 135*c*, and keeping mosquitoes out of the four-device-in-one splash-and-drip-eliminating gazebo
(see FIGS. 6A, 6B, 8G, and 8M).
5) Splash-drip-eliminating bottom-roof system 105 is for performing the combined functions of its components.
6) Bottom roof 106 is for:
Protectively shedding water away from the four-device-in-one splash-and-drip-eliminating gazebo,
in the directions of arrows 136*a*, 136*b*, and 136*c*
(see FIGS. 7F, 7G, 8G, and 8M).
7) Splash-drip-eliminating eaves 107 respectively are for:
a) Extending downward into the inside of rain-water gutters 109
to direct water downward into the inside of rain-water gutters 109
to eliminate water splash and water drip
b) Directing water into rain-water gutters 109
in the directions of arrows 136*b* and 136*c*
to direct water away from gazebo
(see FIGS. 7F, 7G, 8G, and 8M);
c) Collecting rain water
to be used for irrigation
(see FIGS. 7F, 7G, 8G, and 8M); and
d) Protecting occupants from getting wet
to keep them dry and safe
(see FIGS. 7F, 7G, 8G, and 8M).
8) Leaf-filtering gutter-spout post system 108 is for performing the combined functions of its components.
9) Rain-water gutters 109 respectively are for:
a) Directing water into rain-water drain holes 110
in the directions of arrows 137*a* and 137*b*
to direct rain water away from gazebo
(see FIGS. 7E, 7F, 7G, and 7H);
b) Collecting rain water
to be used for irrigation
(see FIGS. 7E, 7F, 7G, and 7H); and
c) Directing water away from occupants
to keep them dry and safe
(see FIGS. 7E, 7F, 7G, and 7H).
10) Rain-water drain holes 110 respectively are for:
a) Draining water away from the four-device-in-one splash-and-drip-eliminating gazebo
to prevent rusting
(see FIGS. 7A, 7C, 7D, 7E, 7G, and 7H);

b) Straining leaves or other debris from getting into leaf-filtering tubes 111
to keep leaf-filtering tubes 111 free from clogs
(see FIGS. 7A, 7C, 7D, 7E, 7G, and 7H);

c) Preventing small birds or animals from entering or nesting inside leaf-filtering tubes 111
to keep leaf-filtering tubes 111 free from clogs
(see FIGS. 7A, 7C, 7D, 7E, 7G, and 7H); and d) Collecting rain water
to be used for irrigation
(see FIGS. 7A, 7C, 7D, 7E, 7G, and 7H).

Figure 7A:
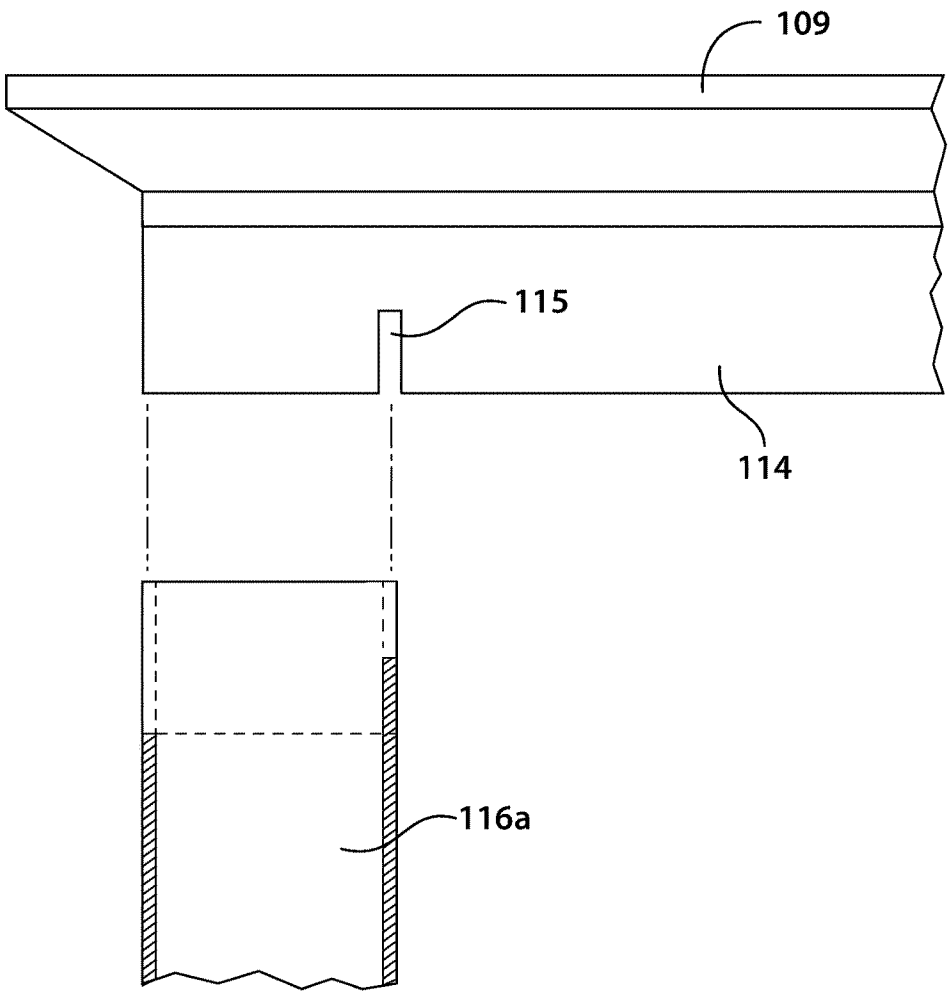
FIGS. 7A, 7B, 7C, and 7D illustrate front, top, and top perspective views of how the top rails and corner posts are assembled.
Figure 7C:
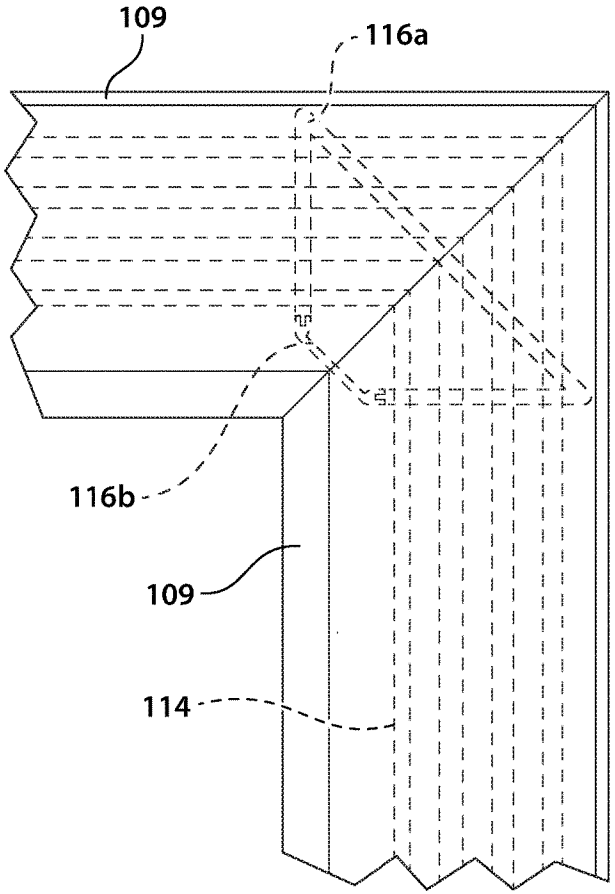
Figure 7B:
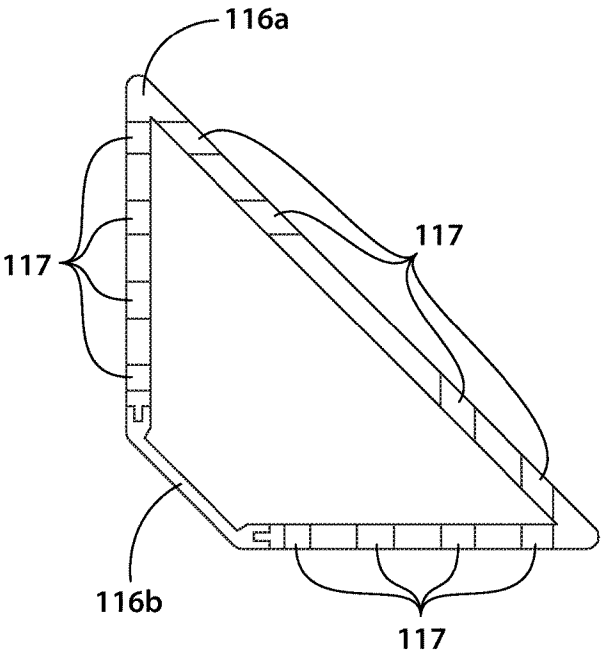
Figure 7D:
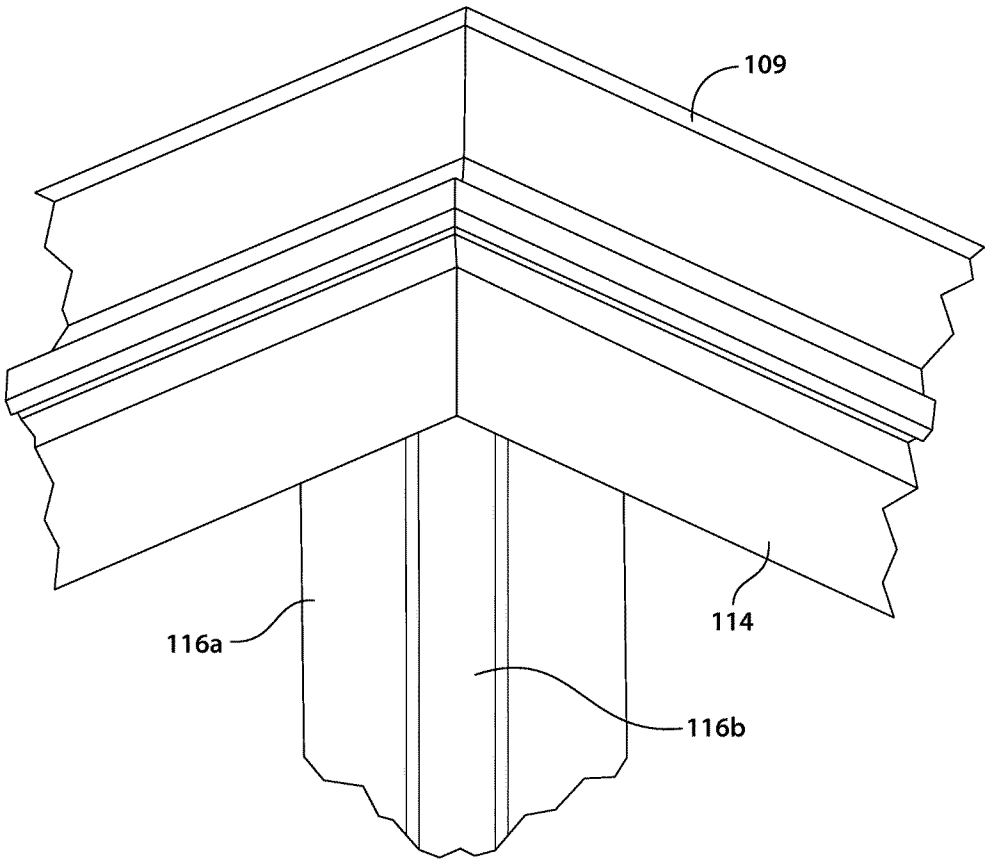
Figure 7E:
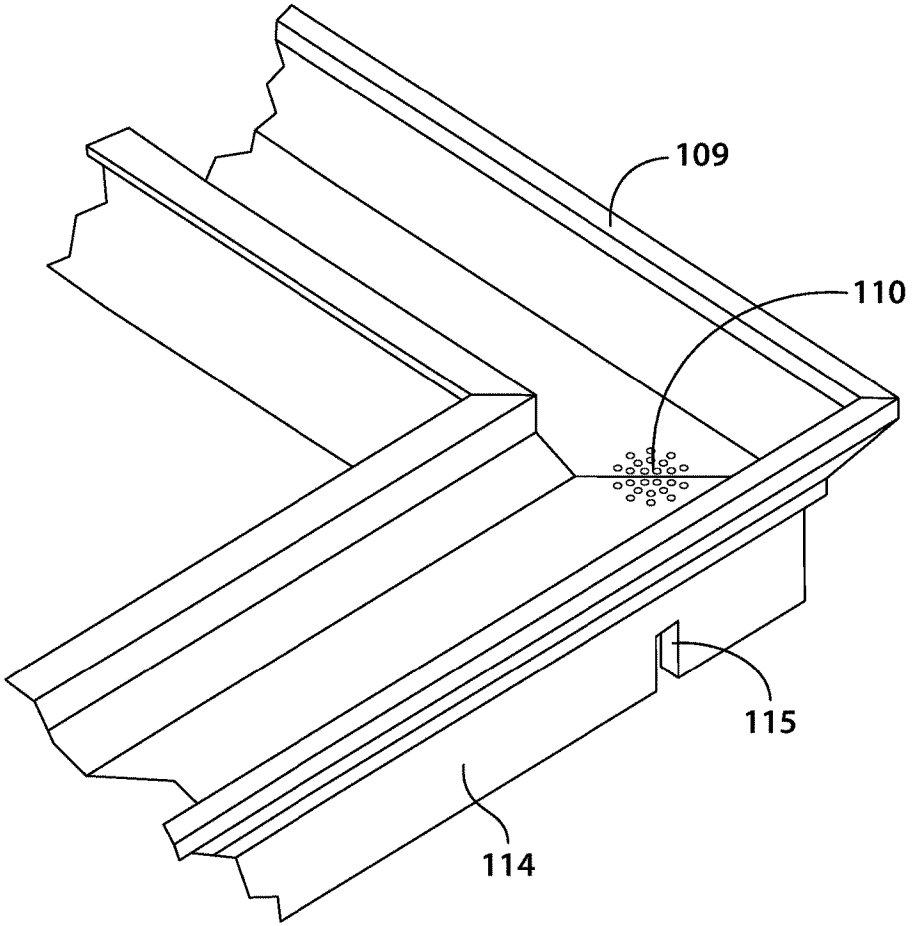
FIGS. 7E, 7F, 7G, and 7H illustrate perspective, cross-sectional, and side views of how the splash-drip-eliminating eaves, top rails, rain-water gutters, leaf-filtering tubes, corner posts, and rain-water-draining spouts are assembled, and function together.
Figure 7F:
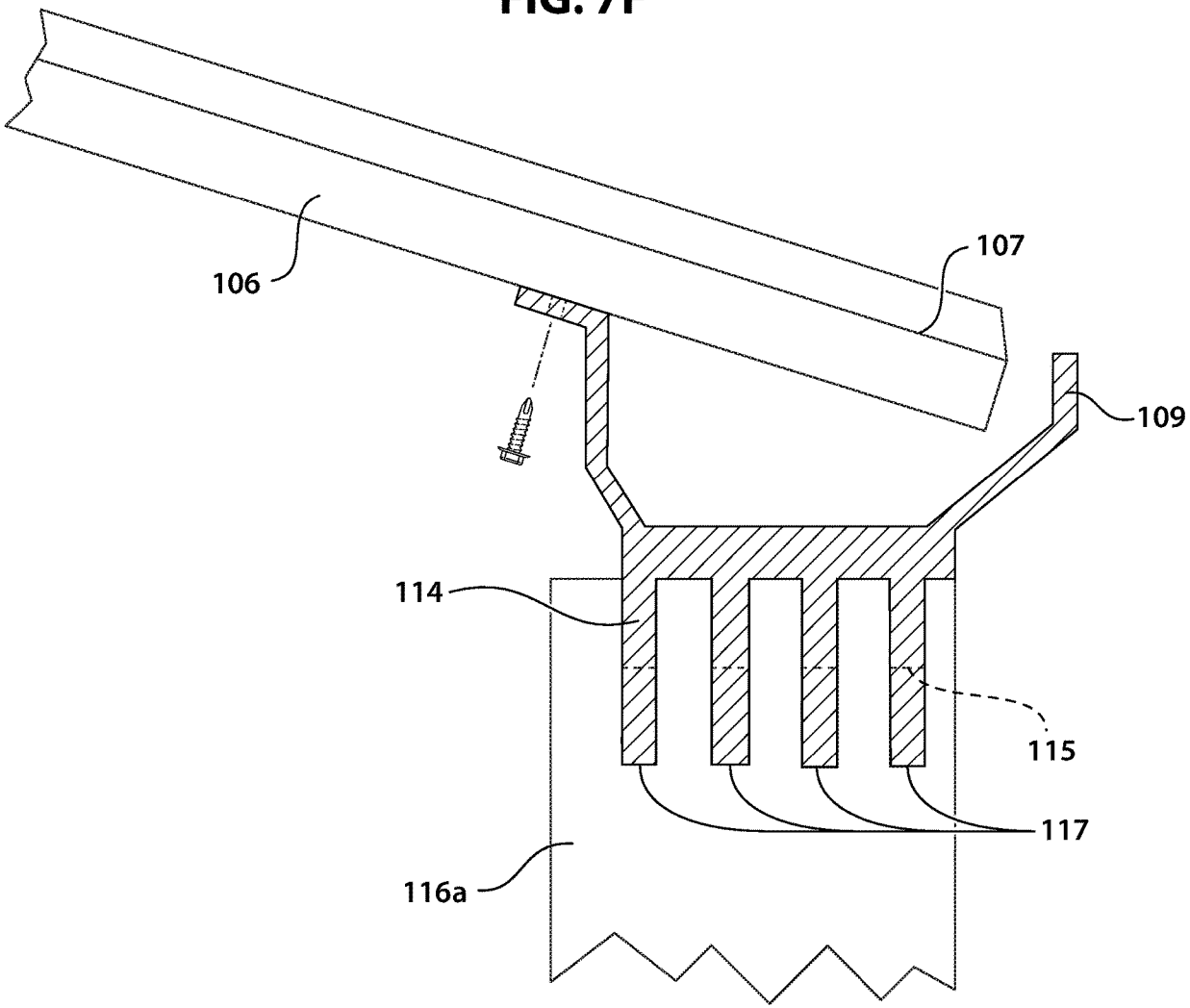
Figure 7H:
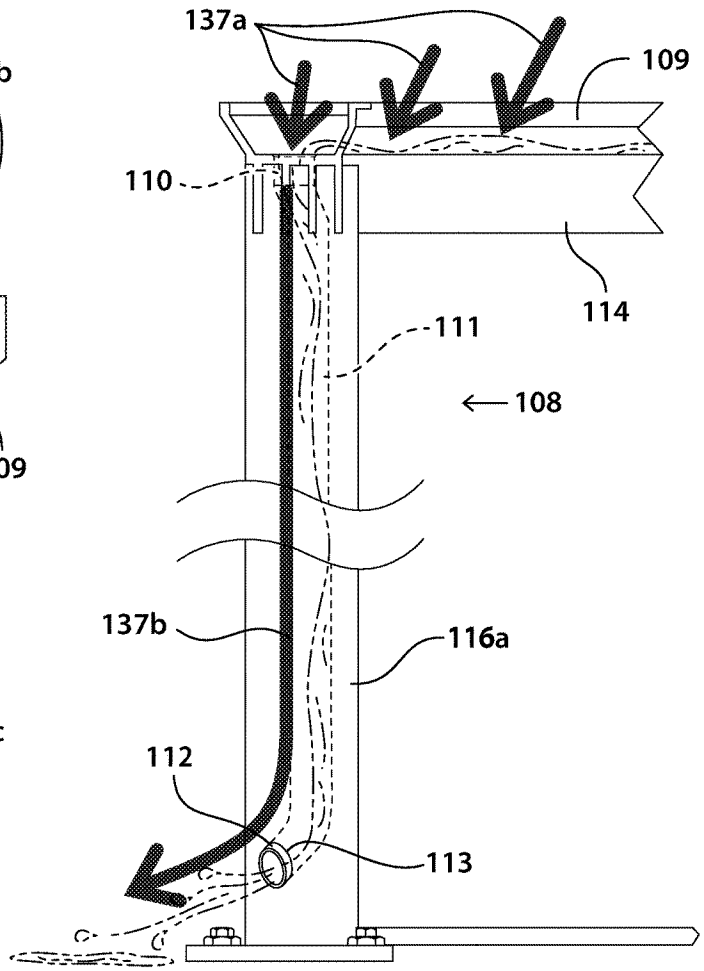
Figure 7G:
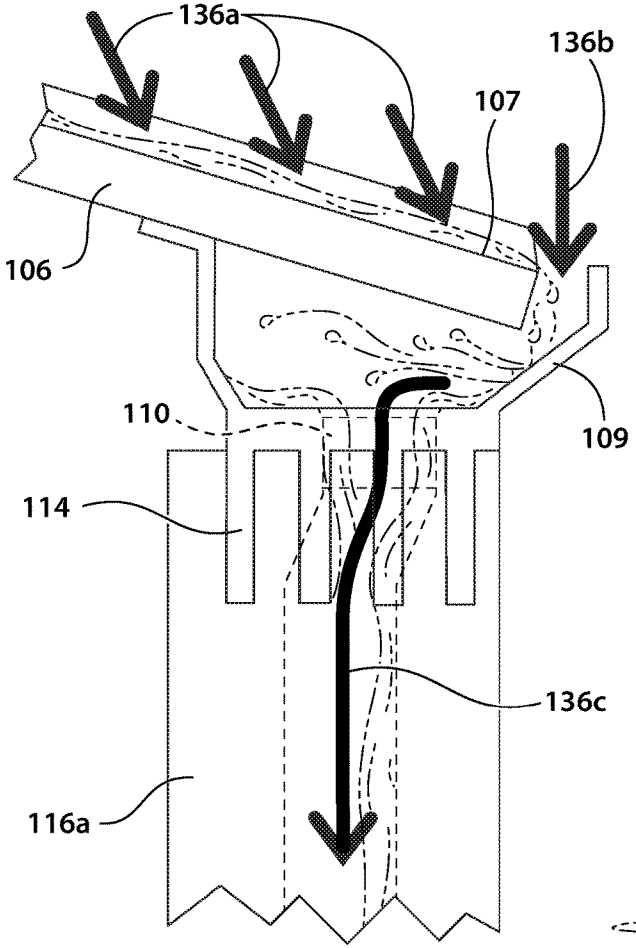

11) Leaf-filtering tubes 111 respectively are for:

a) Filtering leaves and draining water
in the directions of arrows 136*c* and 137*b*
(see FIGS. 7G and 7H);

b) Directing water quickly and safely away from the gazebo
to prevent rusting and wear
in the directions of arrows 136*c* and 137*b*
(see FIGS. 7G and 7H); and c) Directing water quickly and safely away from occupants
to keep them safe and dry
in the directions of arrows 136*c* and 137*b*
(see FIGS. 7G and 7H).

12) Rain-water-draining spouts 112 respectively are for:
Directing water into rain-water-draining spout holes 113
(see FIG. 7H).

13) Rain-water-draining spout holes 113 respectively are for:
Extending rain-water-draining spouts 112 from the inside of corner posts 116*a*
to the outside of corner posts 116*a*
to drain water away from the four-device-in-one splash-and-drip-eliminating gazebo
(see FIG. 7H).

14) Top rails 114 respectively are for:
Allowing multi-purpose door frames 121 to slide horizontally
(see FIGS. 7A, 7C, 7D, 7E, 7F, 7G, and 7H).

15) Post-locking top-rail slots 115 respectively are for:

a) Lockably fastening corner posts 116*a* to top rails 114
to keep gazebo from coming apart and injuring occupants
(see FIGS. 7A, 7D, and 7E);

b) Automatically guiding corner posts 116*a* easily into post-locking top-rail slots 115
to make assembly easier
(see FIGS. 7A, 7D, and 7E); and c) Keeping corner posts 116*a* plumb
to prevent gazebo from twisting
(see FIGS. 7A, 7D, and 7E).

16) Corner posts 116*a* respectively are for:
Strengthening and supporting self-ventilating anti-mosquito top-roof system 101 and splash-drip-eliminating bottom-roof system 105
(FIGS. 7A, 7B, 7C, 7D, 7E, 7E, 7G, and 7H).
Double-U-shaped-end covers 116*b* respectively are for:

a) Allowing access to the inside of corner posts 116*a;* b) Allowing the installation of electrical components on the inside of corner posts 116*a;* c) Allowing the supply of electricity to the four-device-in-one splash-and-drip-eliminating gazebo;

d) Removably covering and protecting contents within corner posts 116*a*, especially electrical components (FIGS. 7B, 7C, and 7D).

17) Top-rail-locking post slots 117 respectively are for:

a) Providing openings for top rails 114 to enter and secure therein
to prevent the gazebo from collapsing
(see FIGS. 7B, 7C, and 7F);

b) Automatically guiding top rails 114 easily into top-rail-locking post slots 117
to make assembly easier
(see FIGS. 7B, 7C, and 7F); and c) Keeping corners and posts plumb
to prevent gazebo from twisting
(see FIGS. 7B, 7C, and 7F).

18) Bottom rails 118 respectively are for:
Allowing multi-purpose door frames 121 to slide horizontally
(see FIGS. 1A, 4A, and 4B).

19) Bottom-rail brackets 119 respectively are for:
Securably connecting bottom rails 118 to corner posts 116*a*
(see FIG. 1B).

20) Multi-purpose multi-configuration panel system 120 is for performing the combined functions of its components.

Figure 8A:
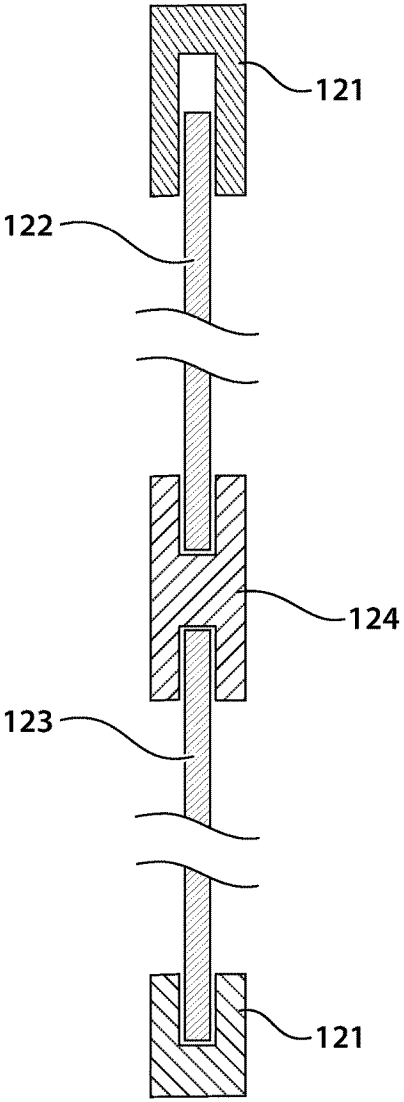
FIGS. 8A, 8B, 8C, 8D, 8E, and 8F illustrate cross-sectional and top perspective views of how the first panels, second panels, and H-shaped panel strips are installed into multi-purpose door frames.
Figure 8B:
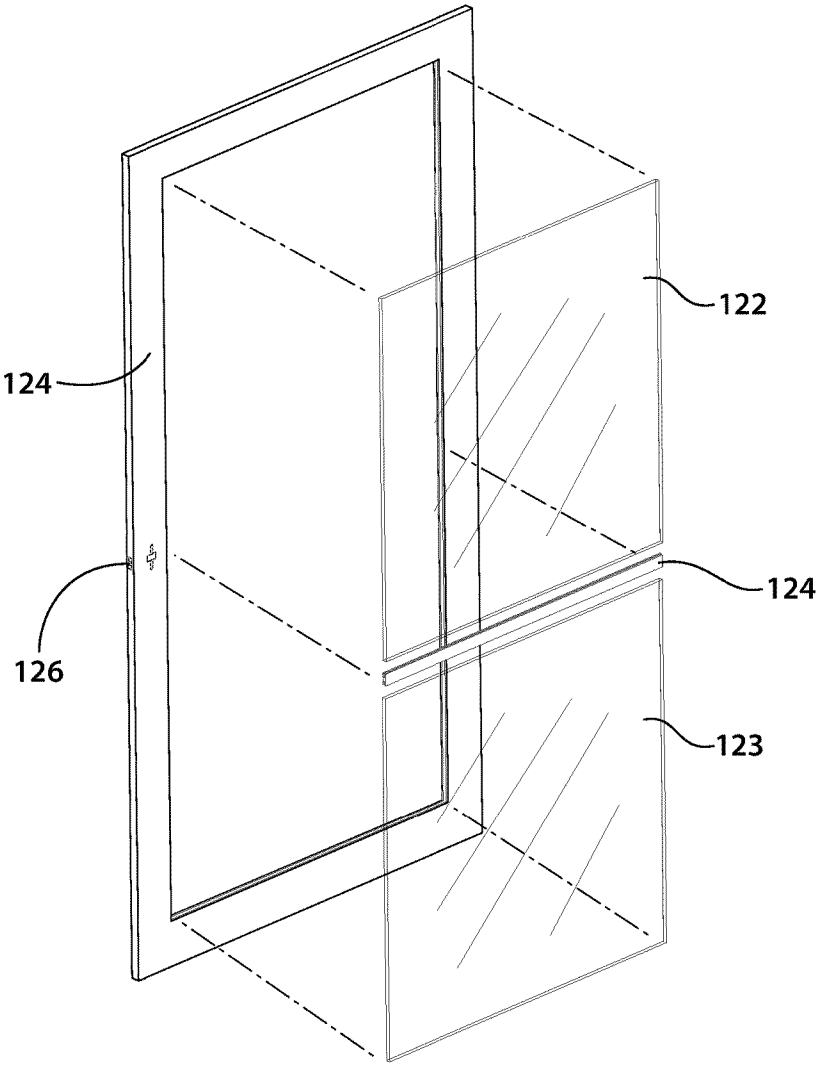
Figure 8D:
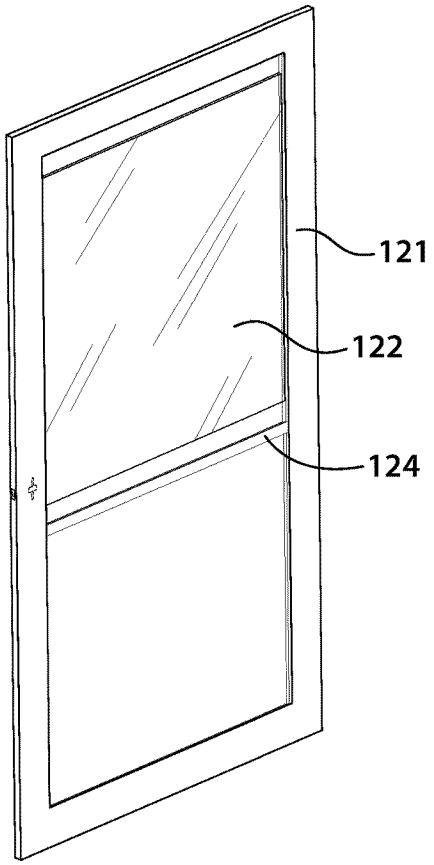
Figure 8C:
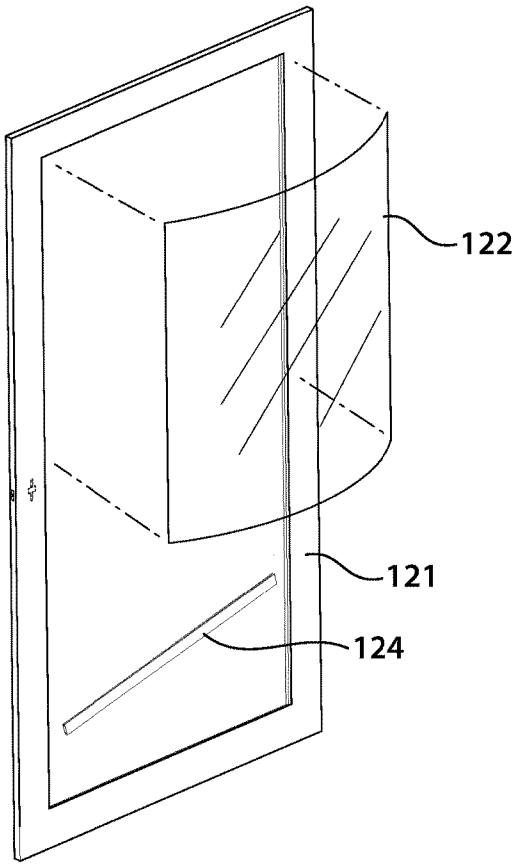
Figure 8F:
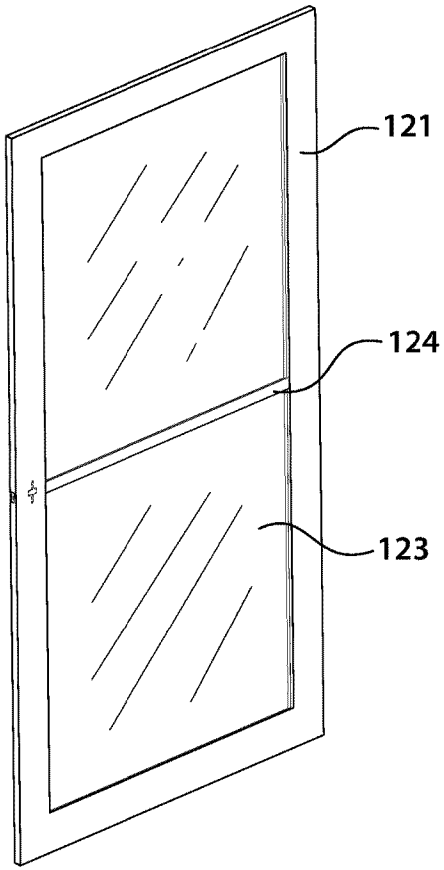
Figure 8E:
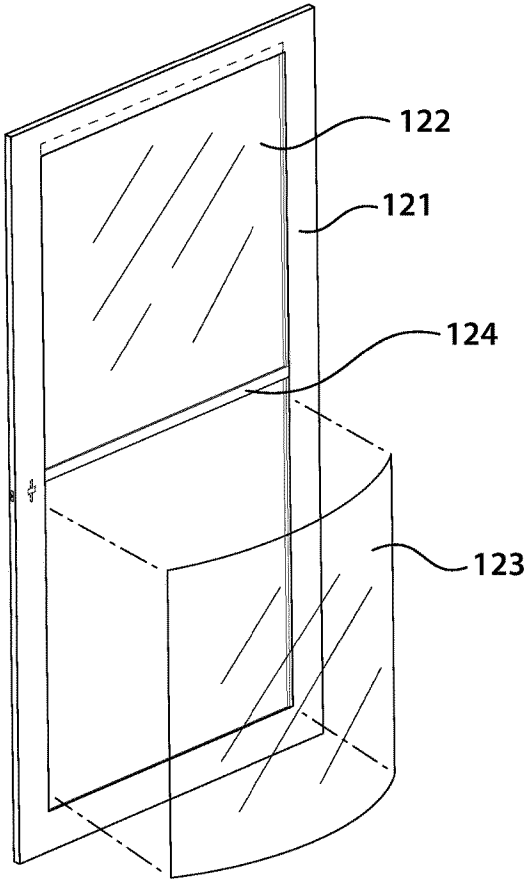
Figure 8G:
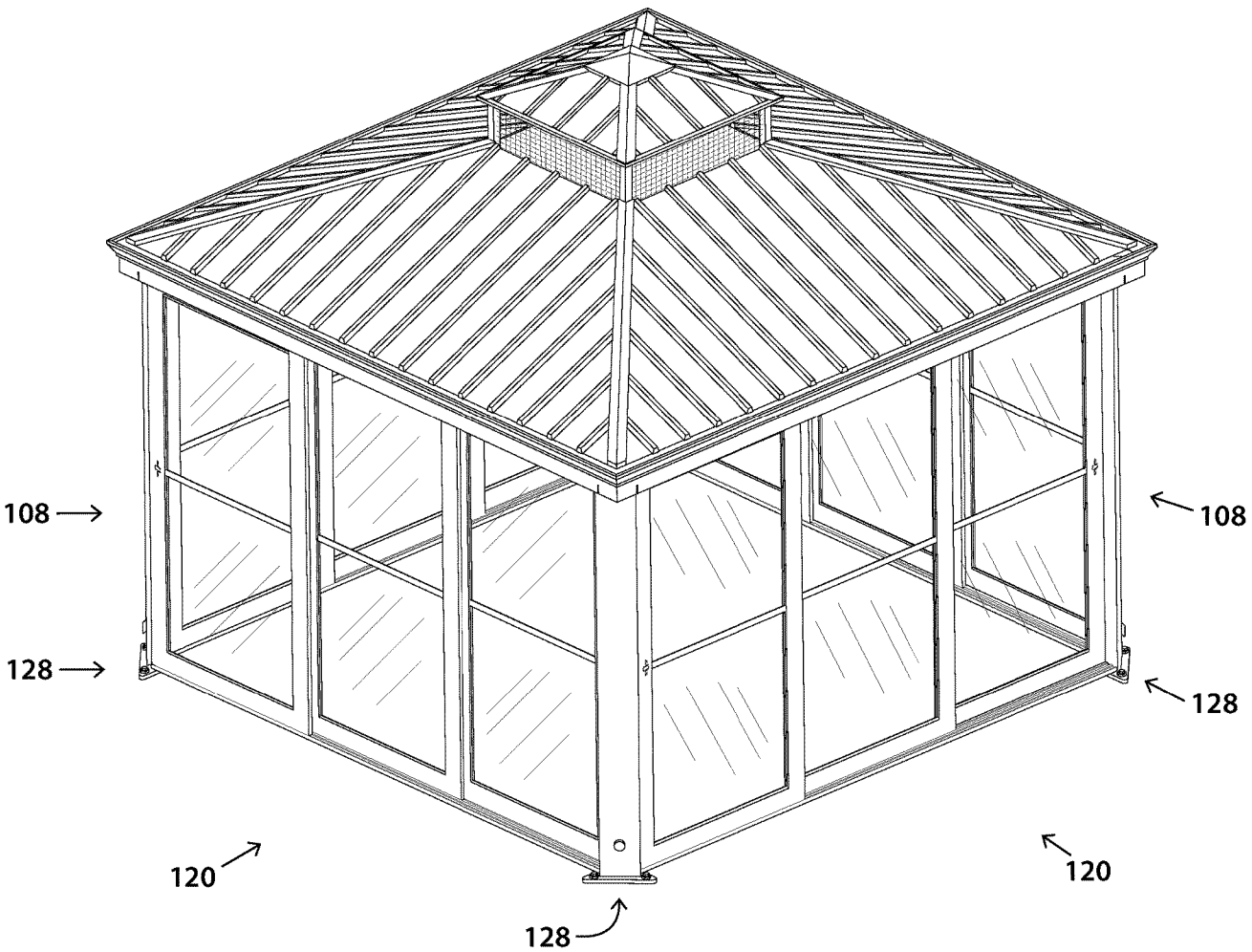
FIGS. 8G, 8H, 8I, 8J, 8K, 8L, and 8M illustrate top perspective and front views of variations of how the multi-purpose door frames, first panels, second panels, and H-shaped panel strips can be configured into the four-device-in-one splash-and-drip-eliminating gazebo.
Figure 8H:
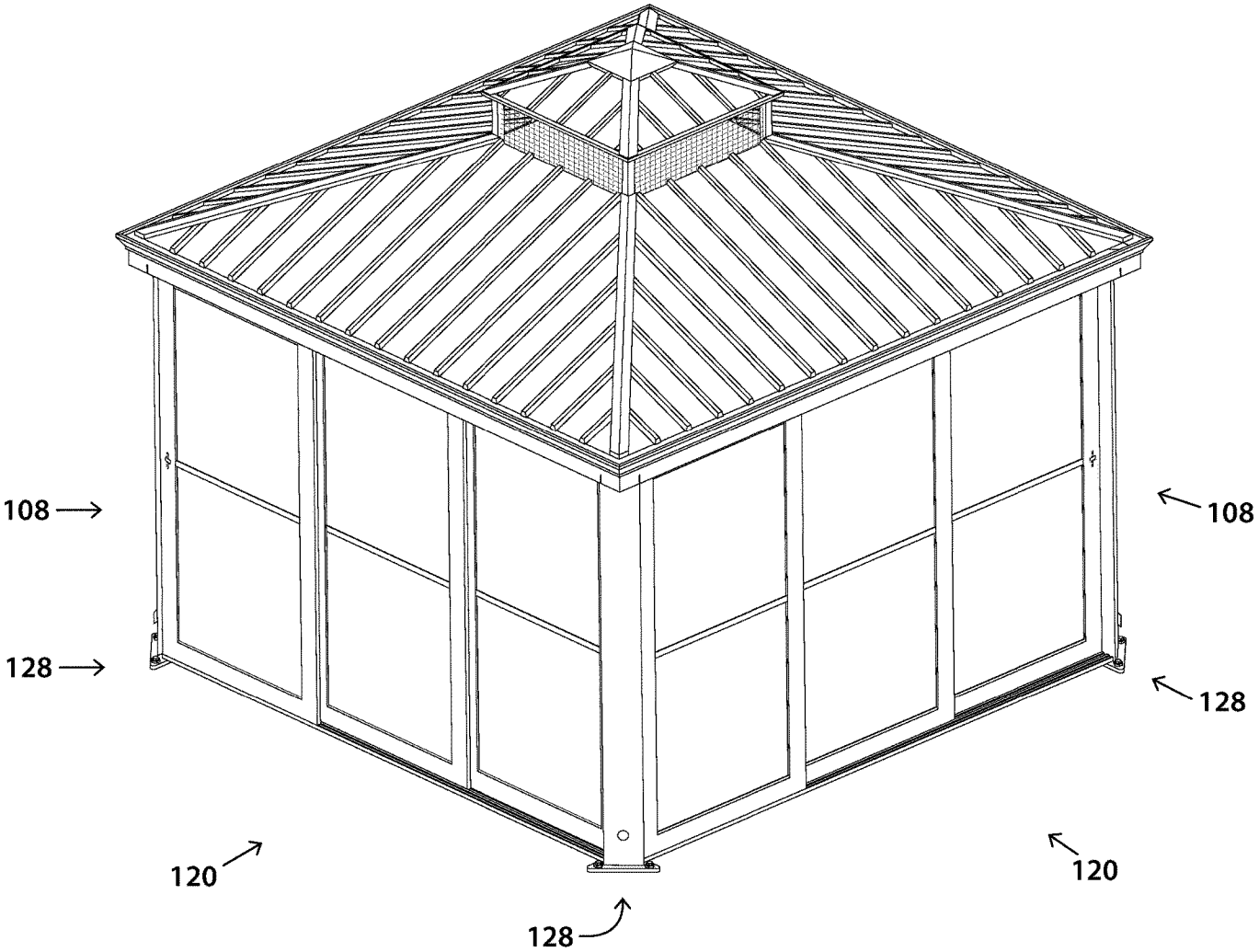
Figure 8I:
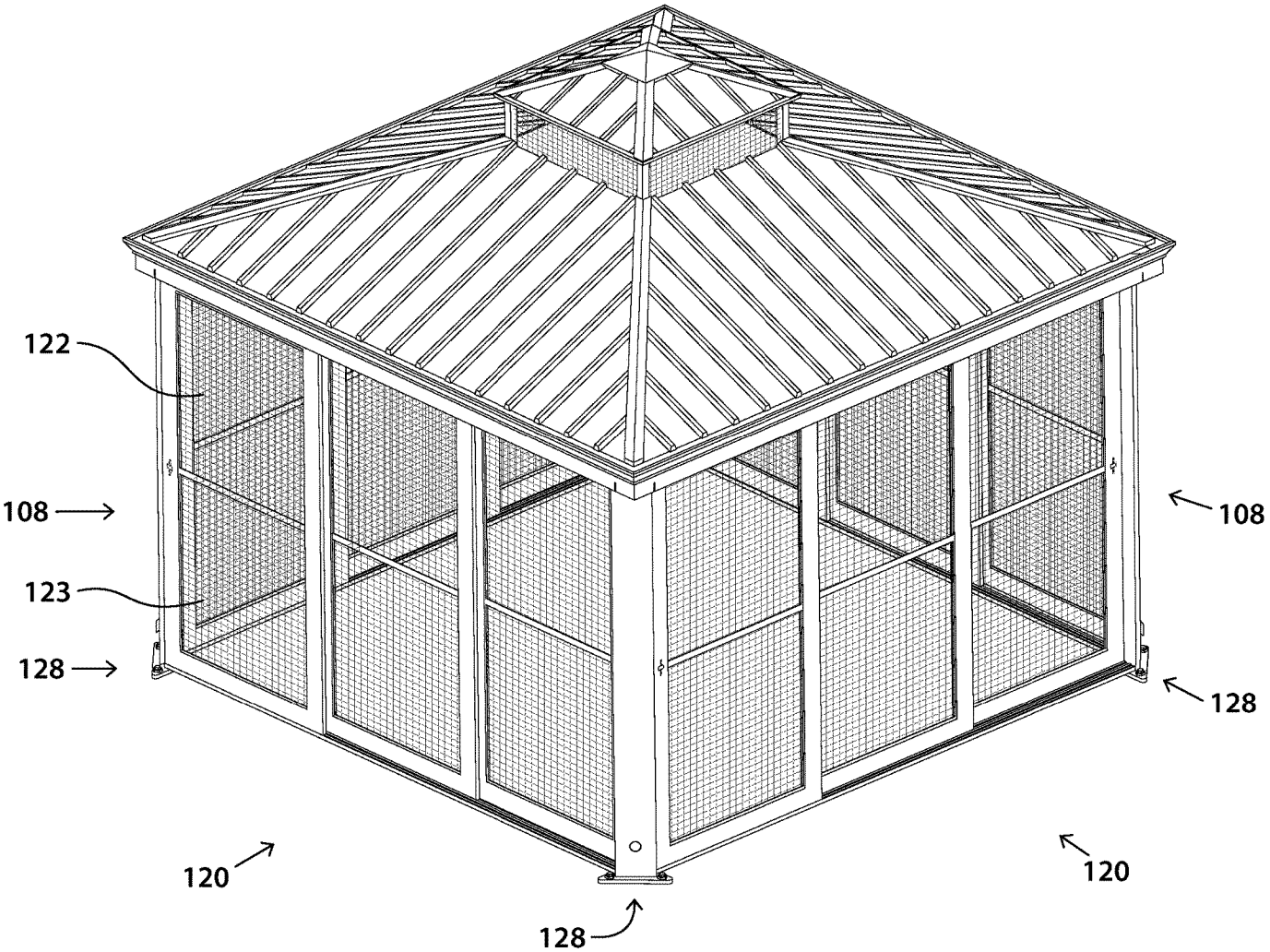
Figure 8J:
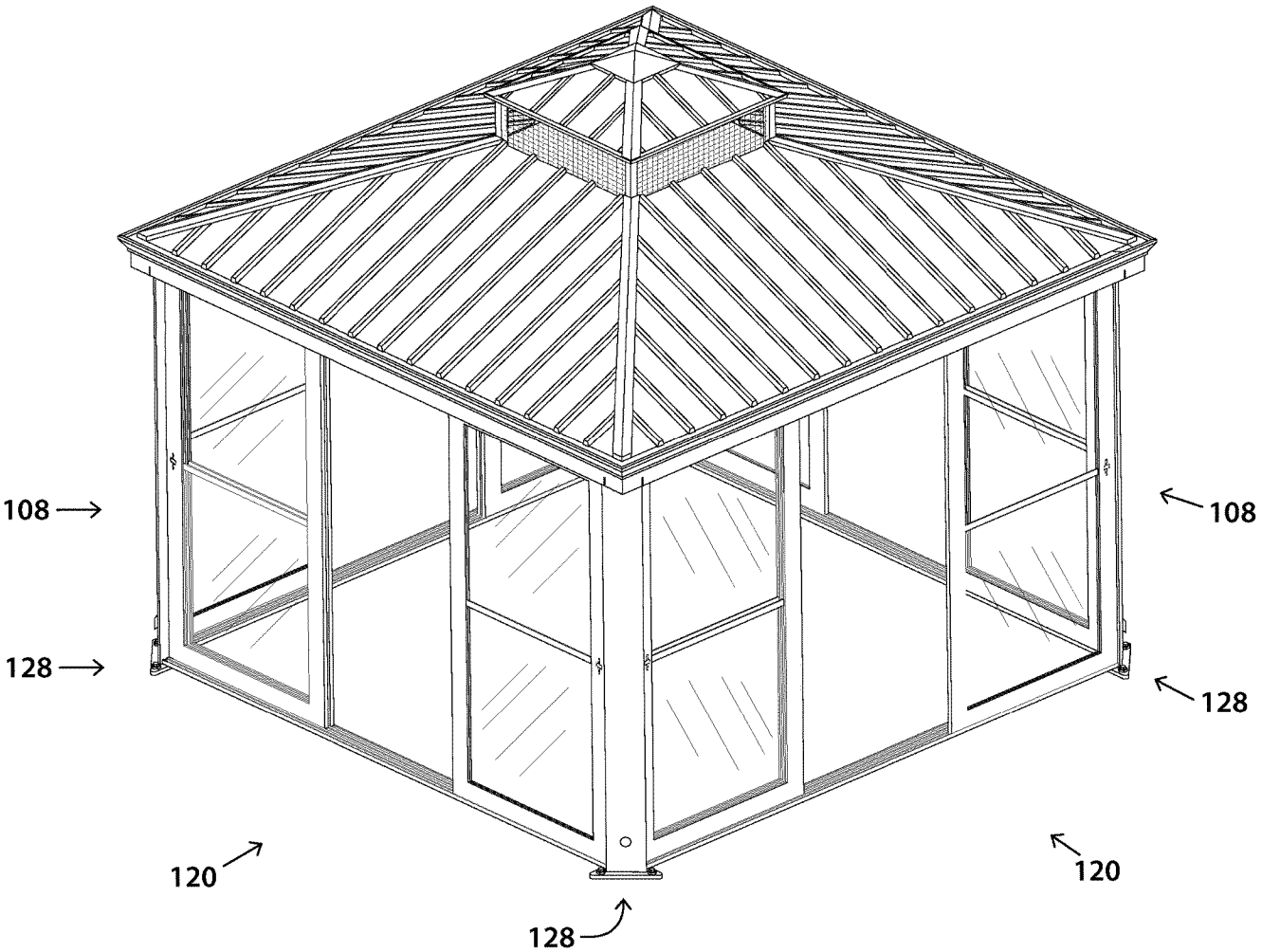
Figure 8K:
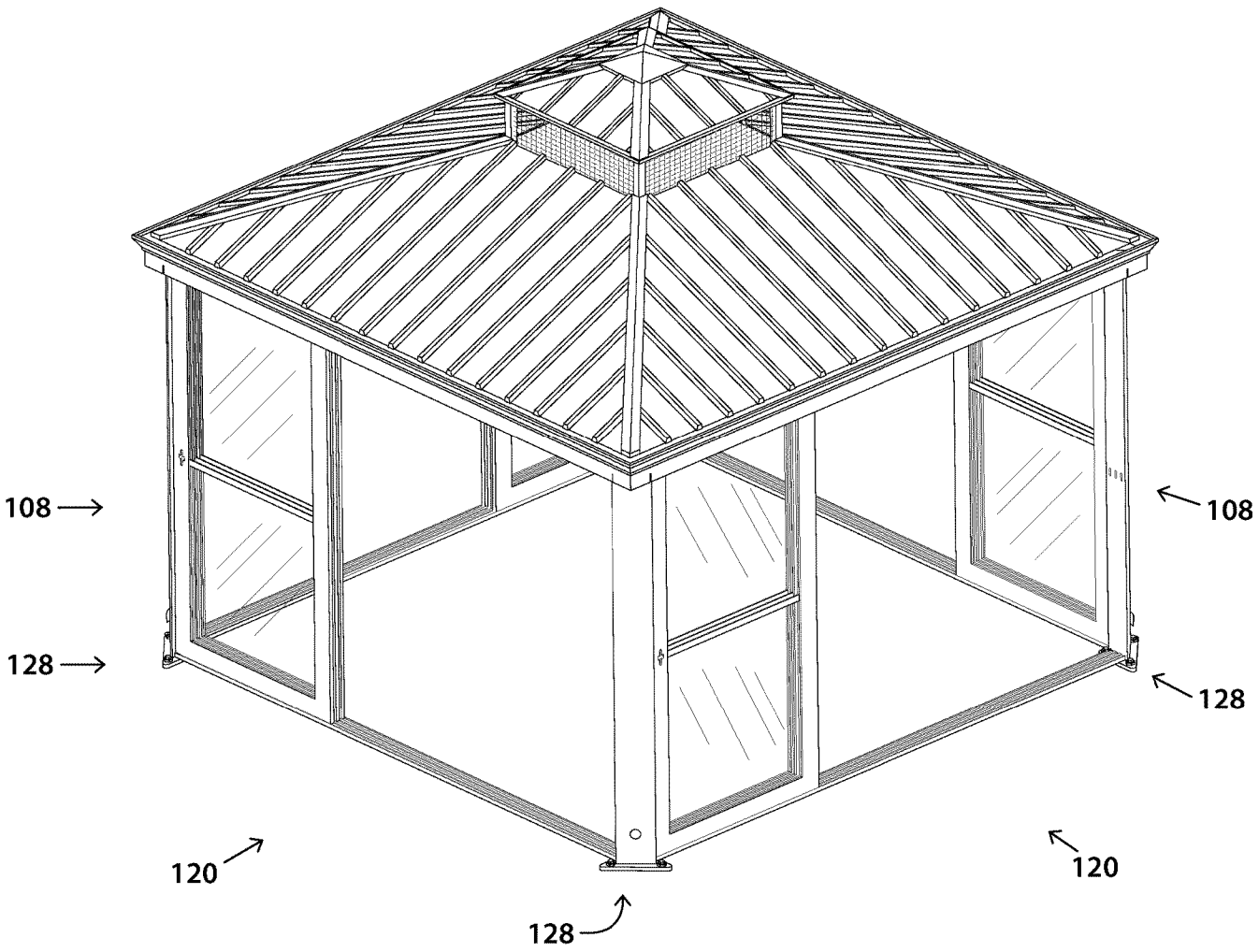
Figure 8L:
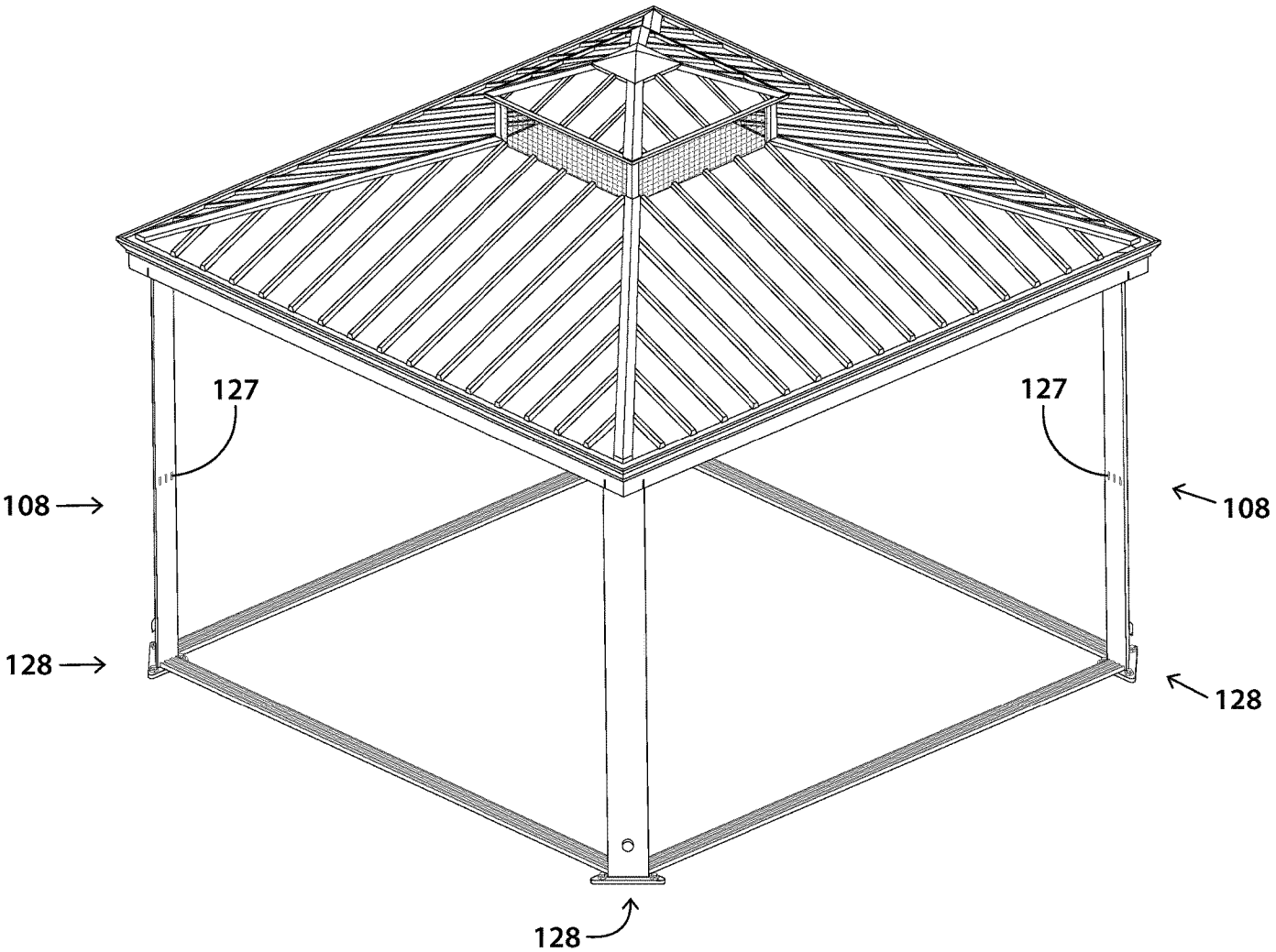
Figure 8M:
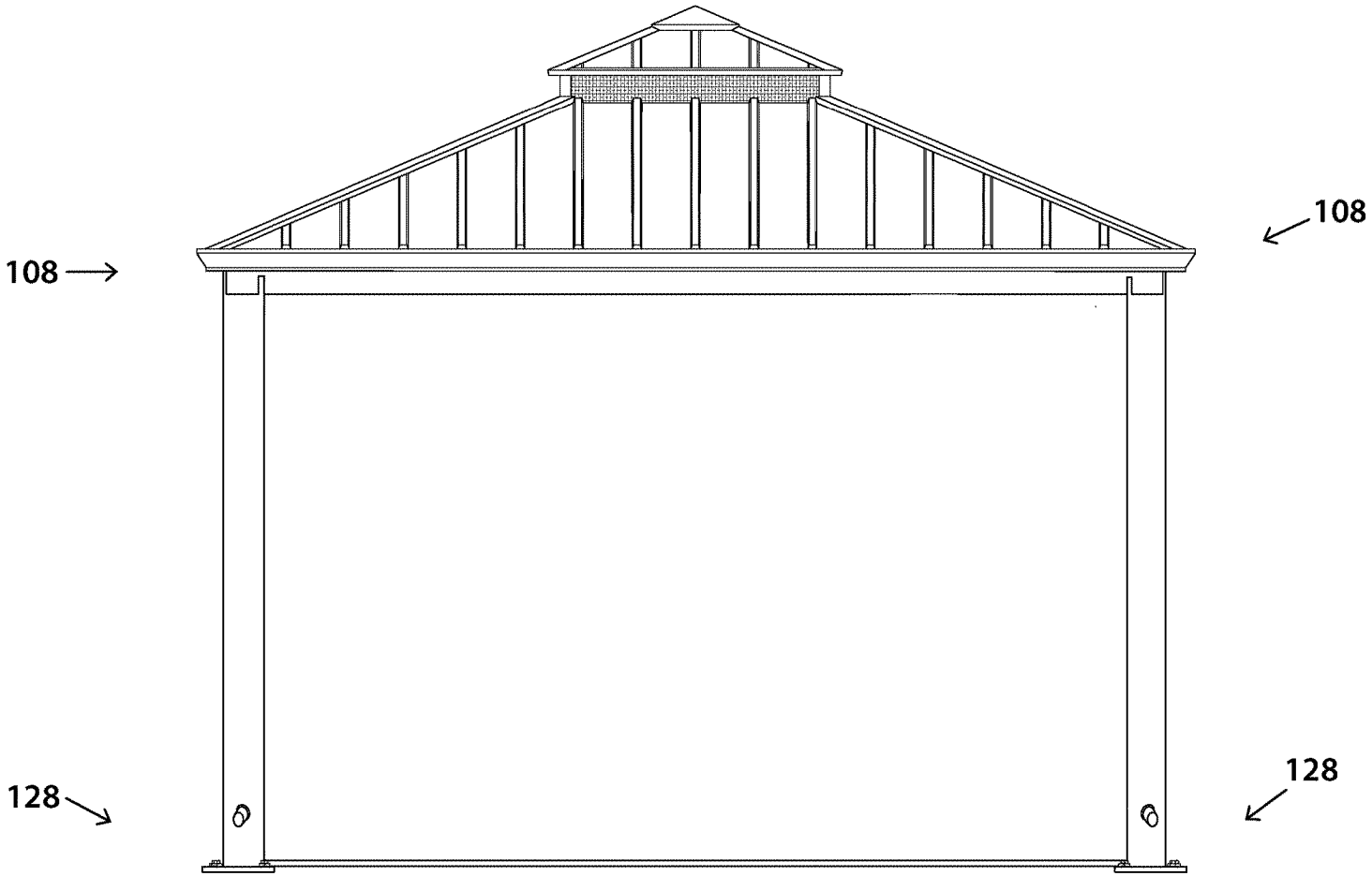
Figure 9A:
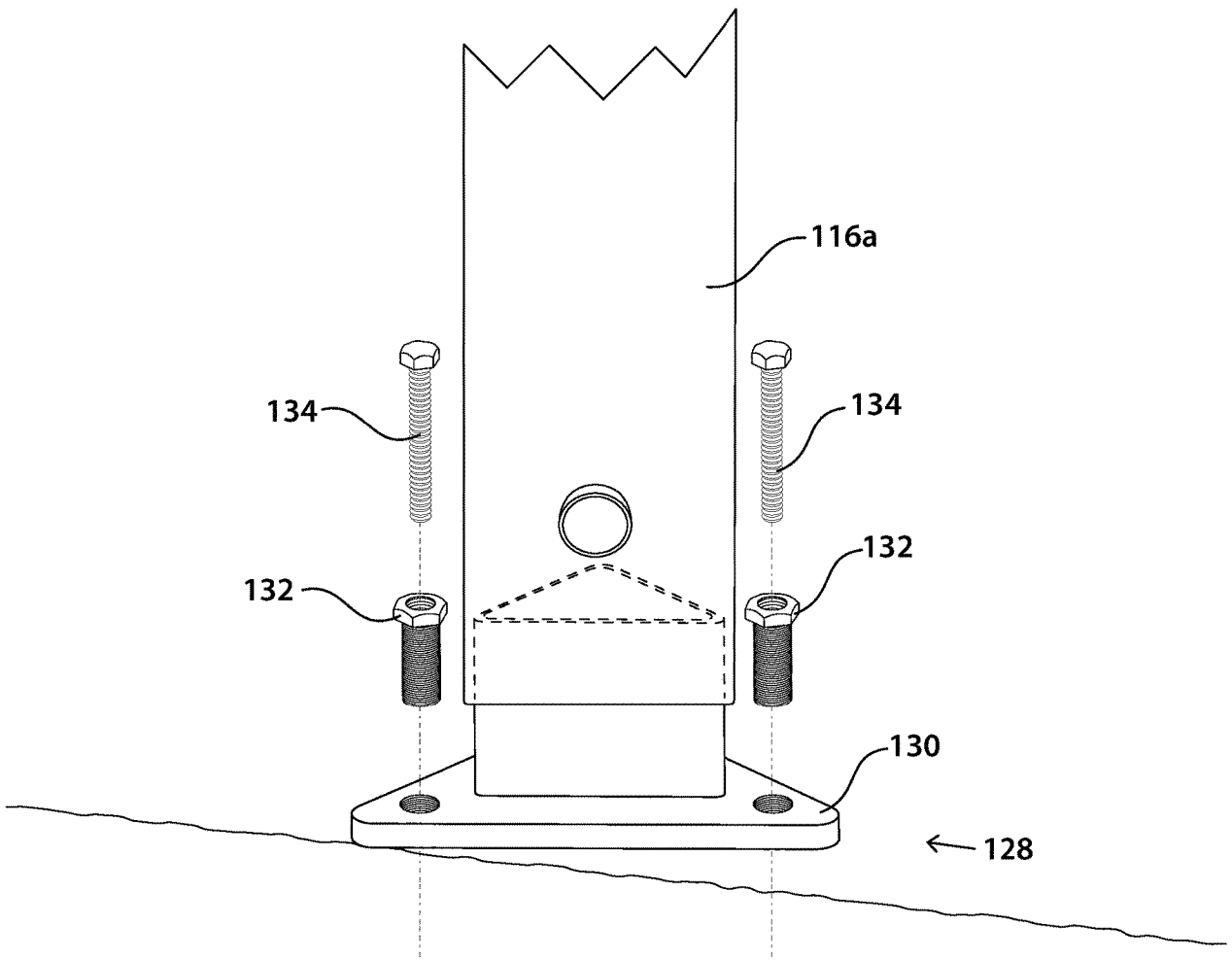
FIGS. 9A, 9B, and 9C illustrate a front perspective view of how to adjust the height of a corner post on uneven ground with height-adjustable tube-screws and anchoring screws.
Figure 9B:
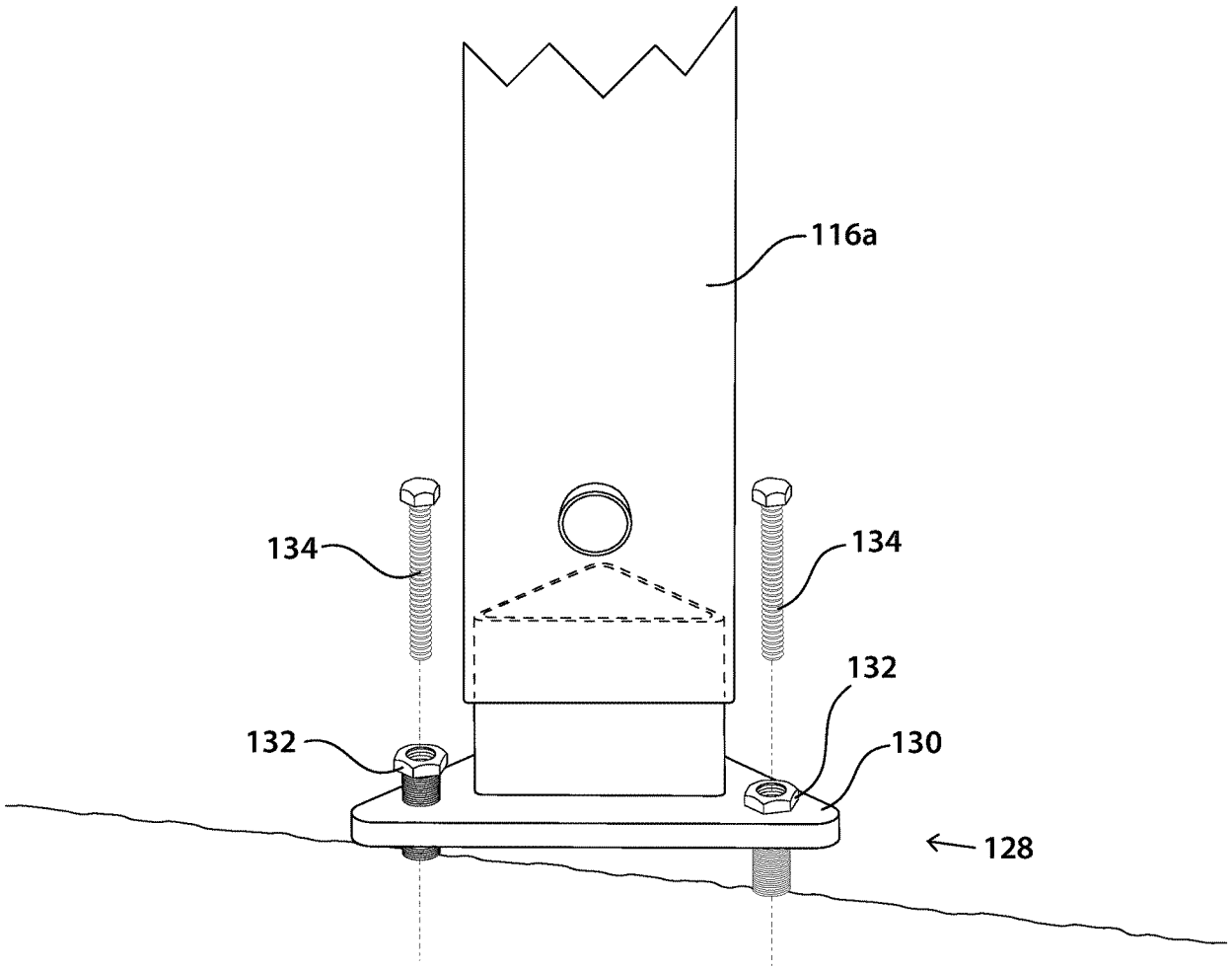
Figure 9C:
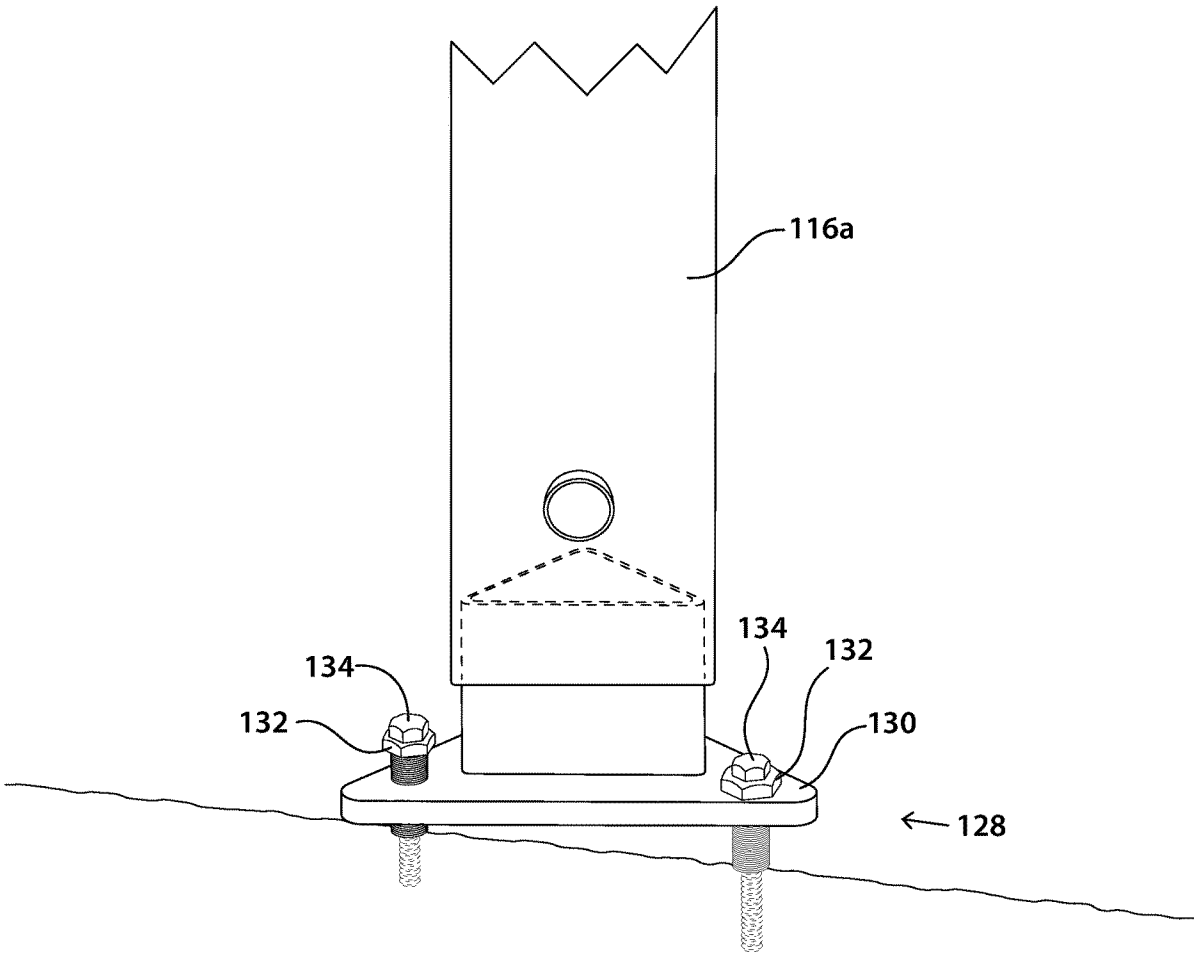

21) Multi-purpose door frames 121 respectively are for:

a) Securably holding screen material first panels 122, screen material second panels 123, and H-shaped panel strips 124
to allow wind to flow through
(see FIG. 8I);

b) Securably holding transparent material first panels 122, transparent material second panels 123, and H-shaped panel strips 124
to provide light to shine through
(see FIGS. 8A, 8B, 8C, 8D, 8E, 8F, 8G, 8J, and 8K);

c) Securably holding opaque material first panels 122, opaque material second panels 123, and H-shaped panel strips 124
to block wind or light
(see FIG. 8H); and d) Allowing quick and easy installation of door panels
to provide numerous door configuration options
(see FIGS. 8A, 8B, 8C, 8D, 8E, 8F, 8G, 8H, 8I, 8J, and 8K).

22) First panels 122 respectively are for:

a) Allowing wind to flow through when functioning with mesh material
to cool occupants
(see FIG. 8I);

b) Providing light to shine through when functioning with transparent material
to provide light to occupants
(see FIGS. 8A, 8B, 8C, 8D, 8E, 8F, 8G, 8J, and 8K); and c) Blocking wind or light when functioning with solid material
(see FIG. 8H).

23) Second panels 123 respectively are for:

a) Allowing wind to flow through when functioning with mesh material
to cool occupants
(see FIG. 8I);

b) Providing light to shine through when functioning with transparent material
to provide light to occupants
(see FIGS. 8A, 8B, 8C, 8D, 8E, 8F, 8G, 8J, and 8K); and c) Blocking wind or light when functioning with solid material
to provide cooling and light to occupants
(see FIGS. 1A and 8H).

24) H-shaped panel strips 124 respectively are for:
Stabilizing first panels 122, and second panels 123
(see FIGS. 8A, 8B, 8C, 8D, 8E, and 8F).

25) Slide-lock slider grips 125 respectively are for:
Slideably locking and unlocking multi-purpose door frames 121 to and from one another
(see FIGS. 1B and 5A).

26) Slide-lock catches 126 respectively are for:
Latching and unlatching multi-purpose door frames 121 to and from one another
(see FIG. 8B).

27) Slide-lock-catch-locking slots 127 respectively are for:
Providing an opening for slide-lock catches 126 to enter and secure therein
(see FIGS. 1A and 8K).

28) Height-adjustable base system 128 is for performing the combined functions of its components.

29) Inner post 129 is for:
Securably connecting corner posts 116*a* to triangular base 130
(see FIGS. 2A and 9).

30) Triangular base 130 is for:
Providing stability for the four-device-in-one splash-and-drip-eliminating gazebo
(see FIGS. 2A and 9).

31) Base holes 131 respectively are for:
Inserting height-adjustable tube-screws 132 therethrough.

Figure 2B:
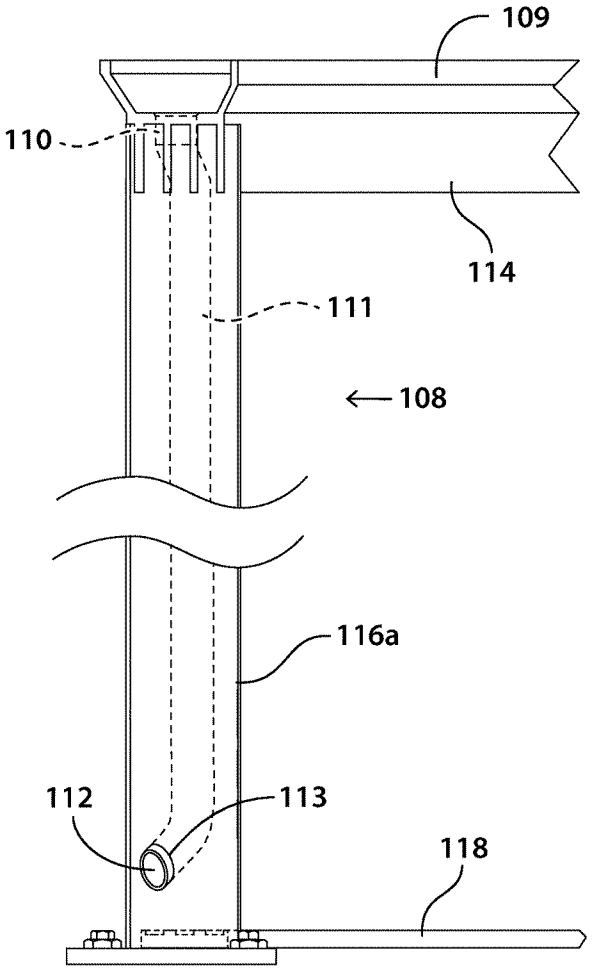
FIGS. 2A and 2B illustrate front views of how top rails, corner posts, rain-water gutters, rain-water drain holes, leaf-filtering tubes, and a height-adjustable base system are assembled.
Figure 2A:
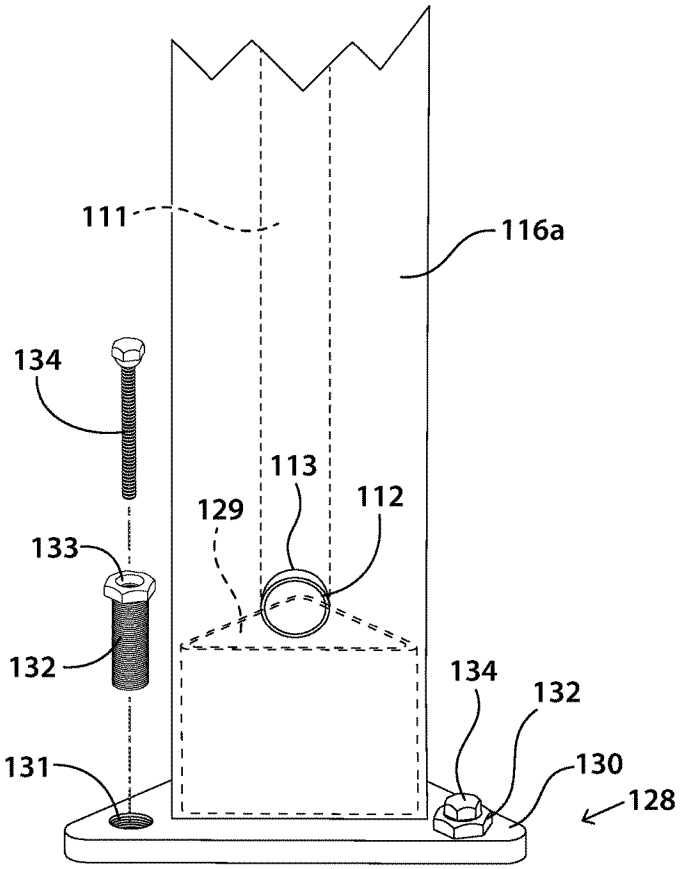
Figure 3B:
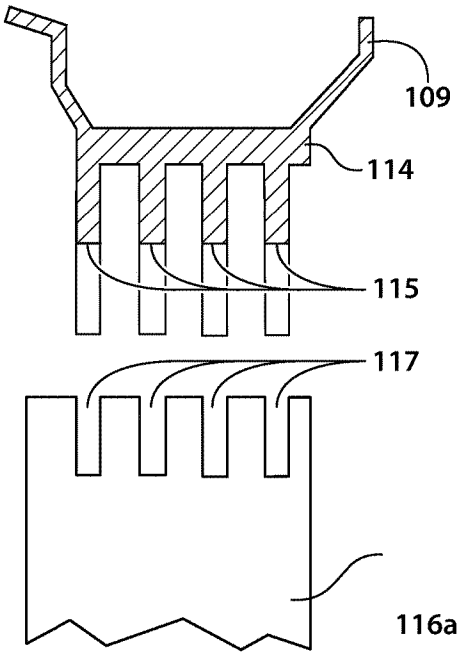
FIGS. 3A, 3B, 4A, and 4B illustrate right side sectional, right side, and top perspective views of top rails, rain-water gutters, leaf-filtering tubes, corner posts, and bottom rails.
Figure 3A:
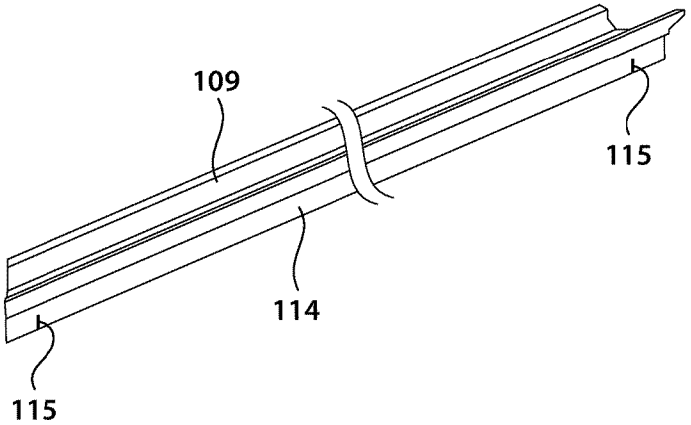
Figure 4B:
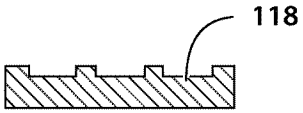
Figure 4A:
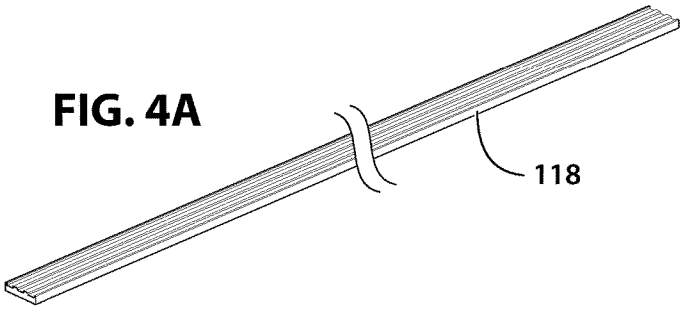
Figure 5B:
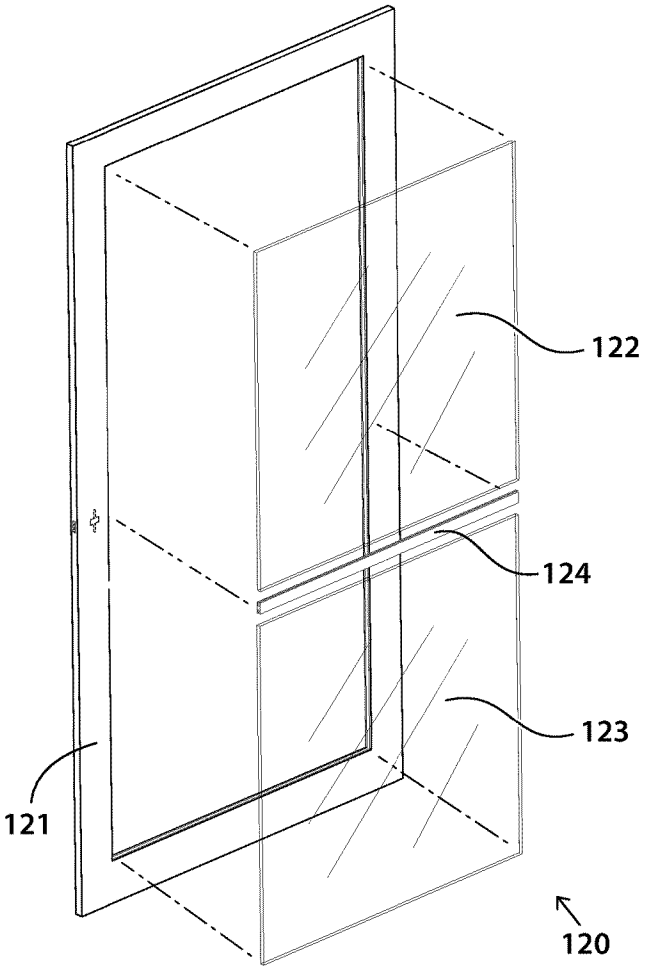
FIGS. 5A and 5B illustrate top perspective views of multi-purpose door frames, first panels, second panels, H-shaped panel strips, slide-lock slider grips, and slide-lock catches.
Figure 5A:
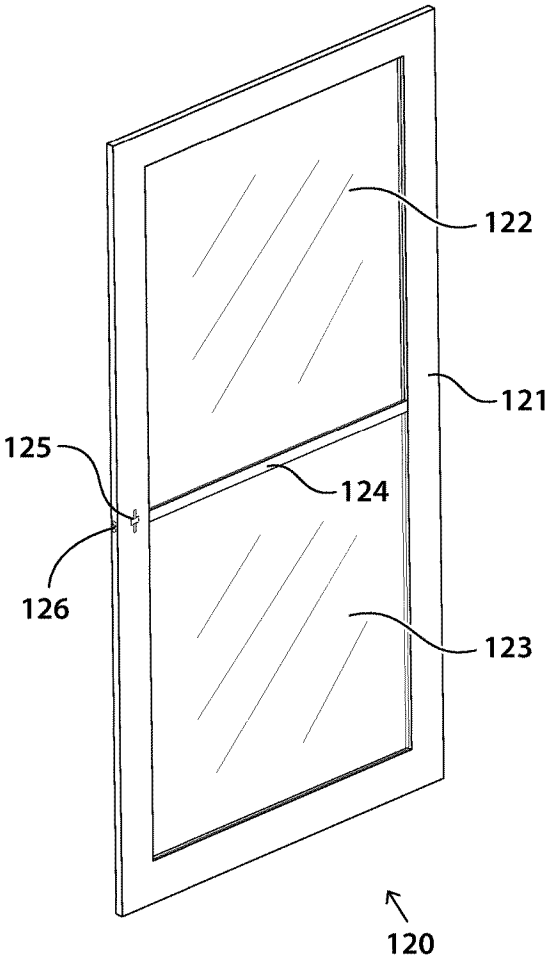
Figure 6A:
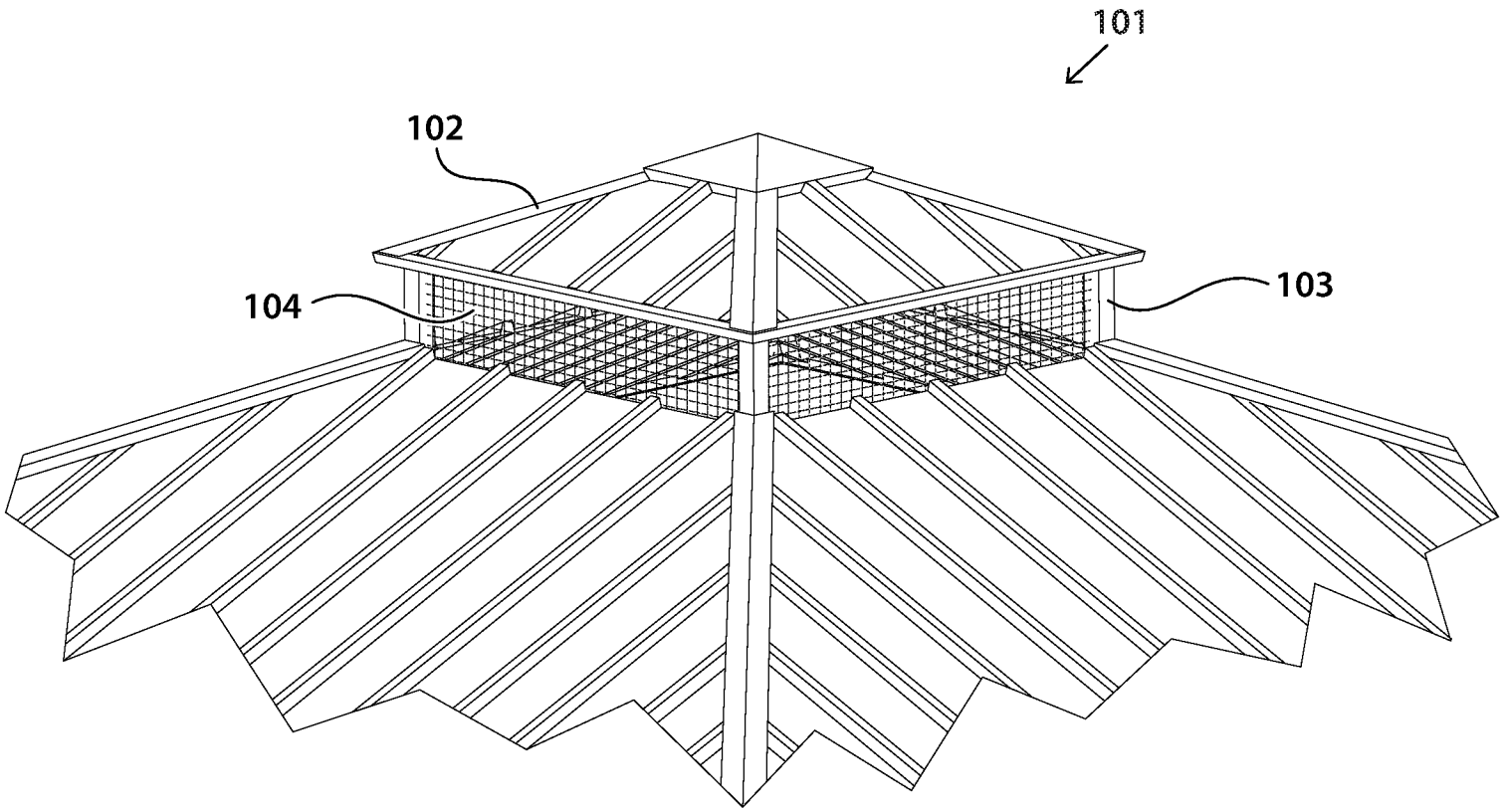
FIGS. 6A and 6B illustrate a top perspective and a front view of a self-ventilating anti-mosquito top-roof system, and demonstrating the wind-flow therethrough.
Figure 6B:
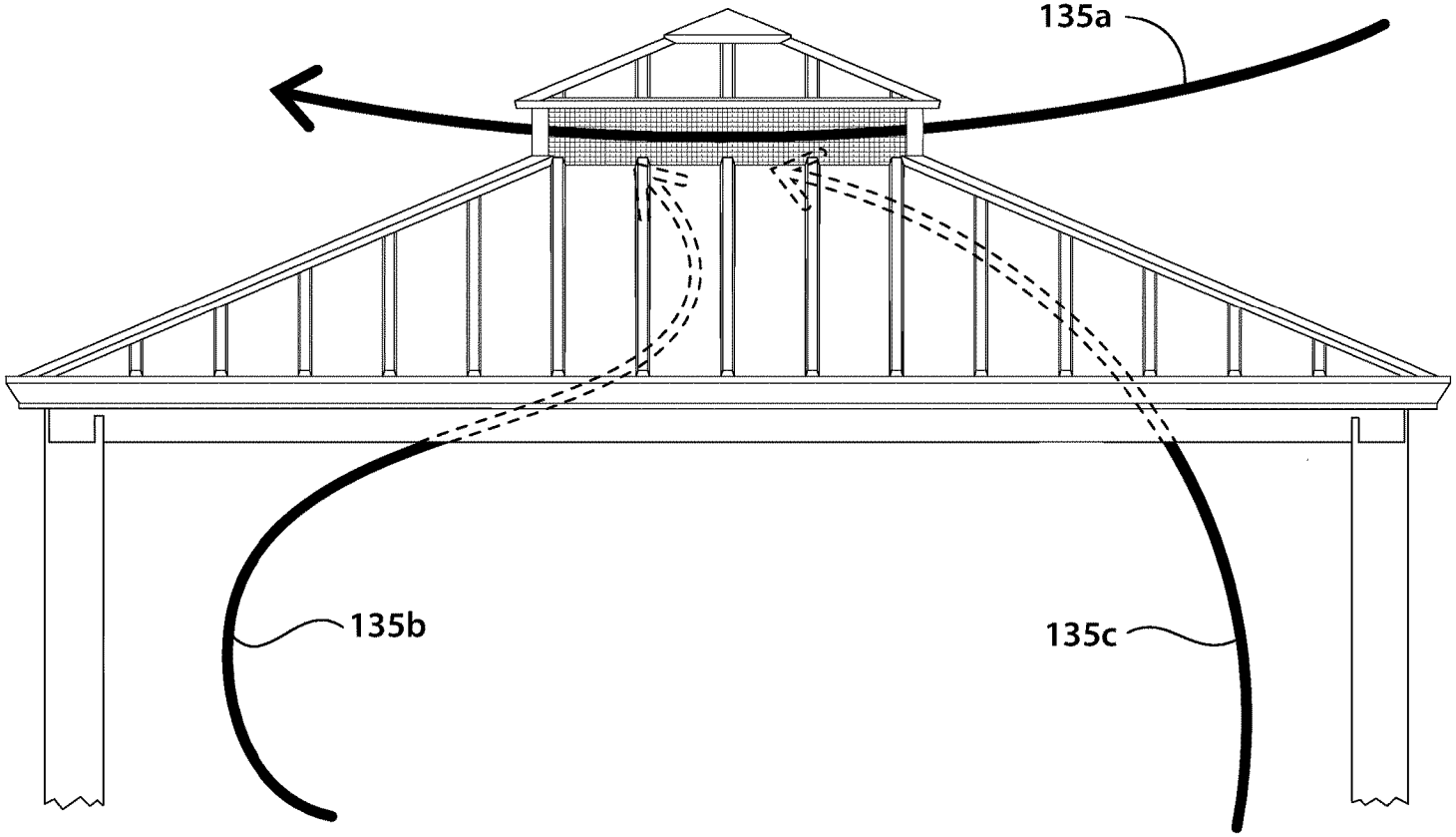

32) Height-adjustable tube-screws 132 respectively are for:
a) Securably screwing into base holes 131
to provide vertical adjustability
(see FIGS. 2A and 9);
b) Adjusting height of corner posts 116*a*
to compensate for uneven terrain
(see FIGS. 2A and 9);
c) Adjusting height of corner posts 116*a*
to compensate for uneven concrete surface
(see FIGS. 2A and 9);
d) Adjusting height of corner posts 116*a*
to compensate for uneven deck surface
(see FIGS. 2A and 9); and
e) Leveling the gazebo
to keep water drainage working properly
(see FIGS. 2A and 9).

33) Anchoring-screw holes 133 respectively are for:
Inserting anchoring screws 134 therethrough.

34) Anchoring screws 134 respectively are for:
Securing and strengthening triangular base 130 and the four-device-in-one splash-and-drip-eliminating gazebo to the ground
(see FIGS. 2A and 9).

Variation

Figure 10B:
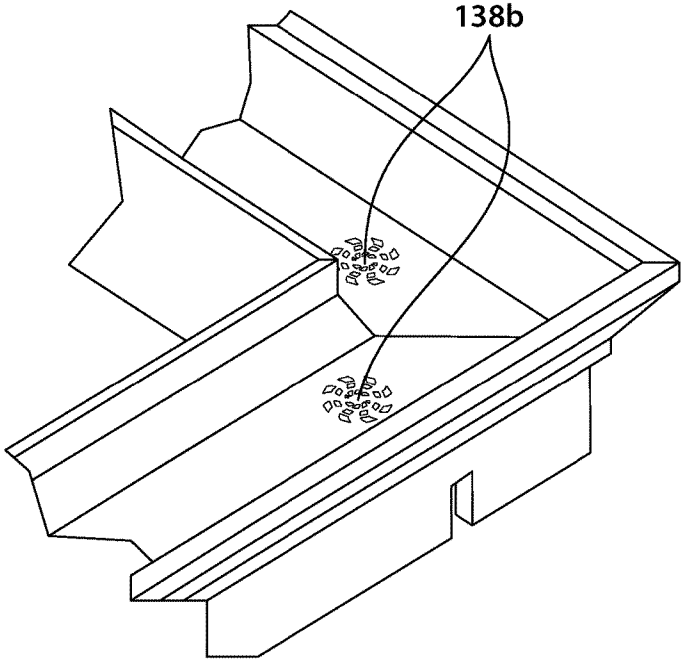
FIGS. 10A and 10B illustrate top perspective views of variations of rain-water drain holes in rain-water gutters.
Figure 10A:
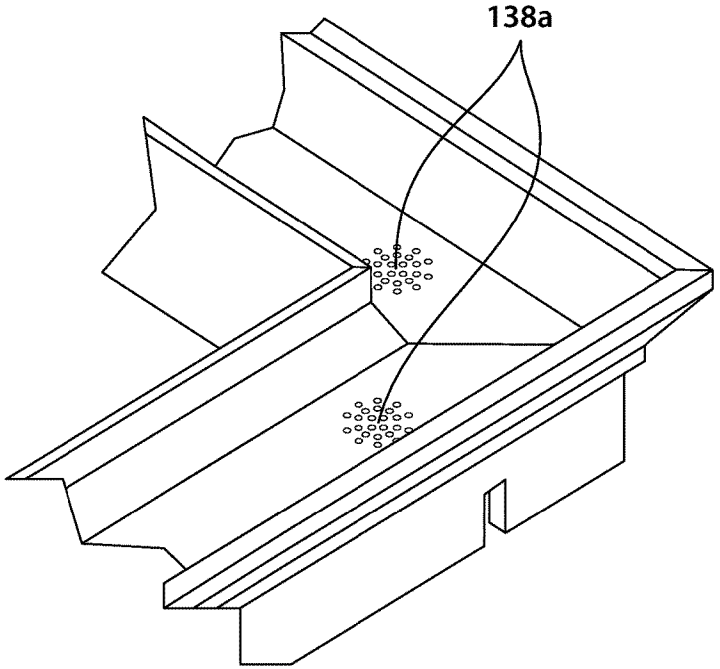
Figure 11B:
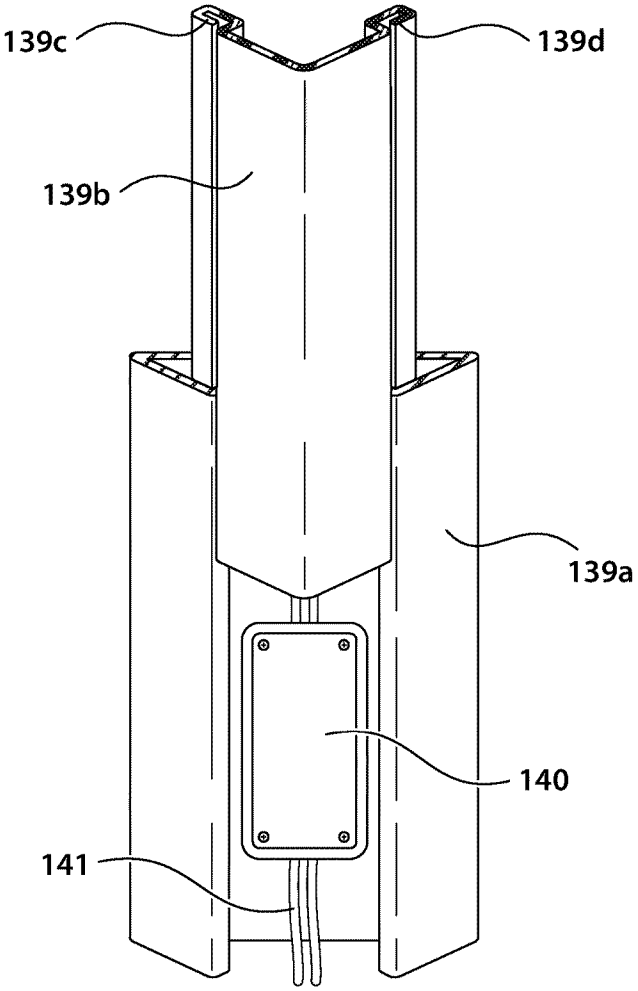
FIGS. 11A and 11B illustrate cross-sectional and perspective views of a variation of a two-part triangular corner post with a rain-water-draining spout or an electrical connection box, which integrates an external electrical source to the four-device-in-one splash-and-drip-eliminating gazebo.
Figure 11A:
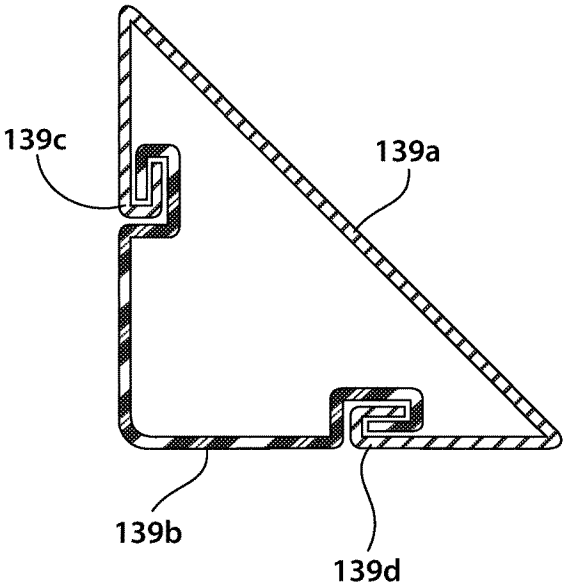
Figure 11D:
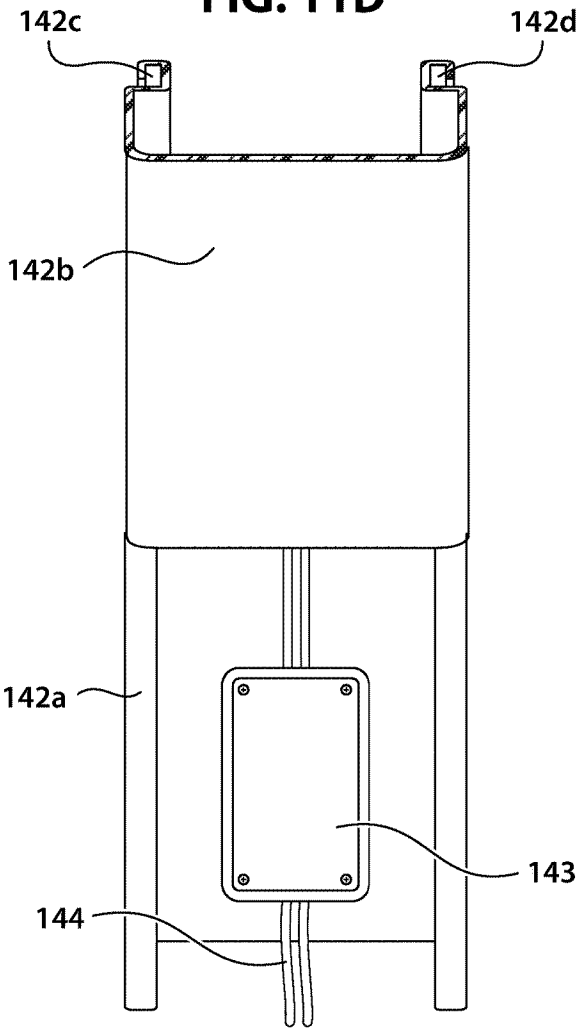
FIGS. 11C and 11D illustrate cross-sectional and perspective views of a variation of a two-part square corner post with a rain-water-draining spout or an electrical connection box, which integrates an external electrical source to the four-device-in-one splash-and-drip-eliminating gazebo.
Figure 11C:
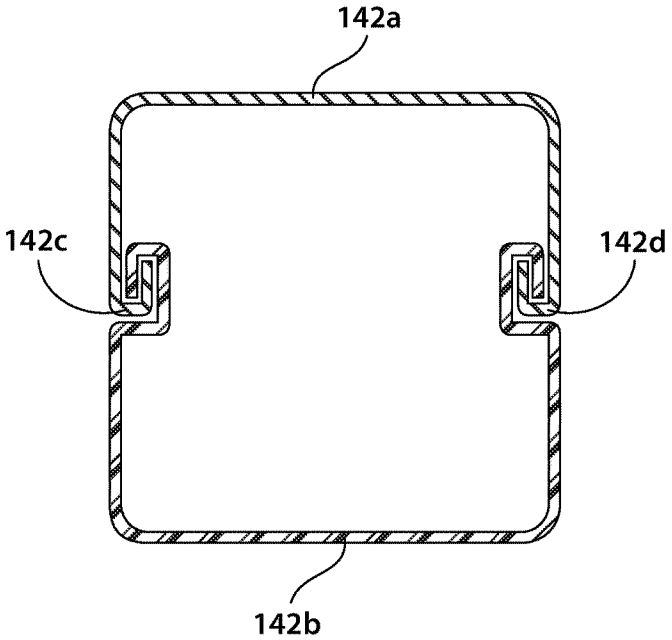
Figure 11F:
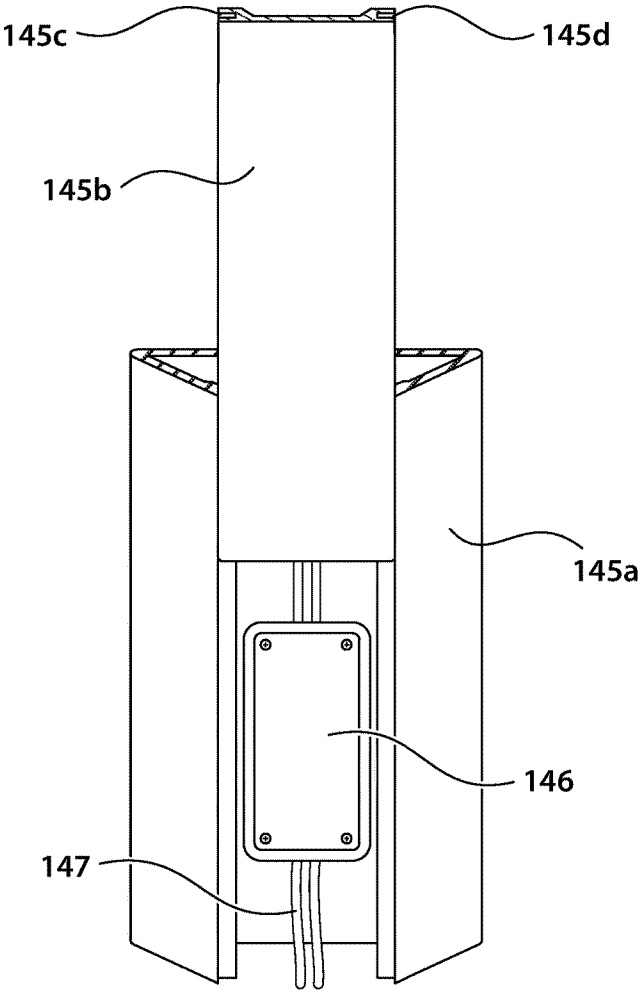
FIGS. 11E and 11F illustrate cross-sectional and perspective views of a variation of a two-part triangular corner post with a rain-water-draining spout or an electrical connection box, which integrates an external electrical source to the four-device-in-one splash-and-drip-eliminating gazebo.
Figure 11E:
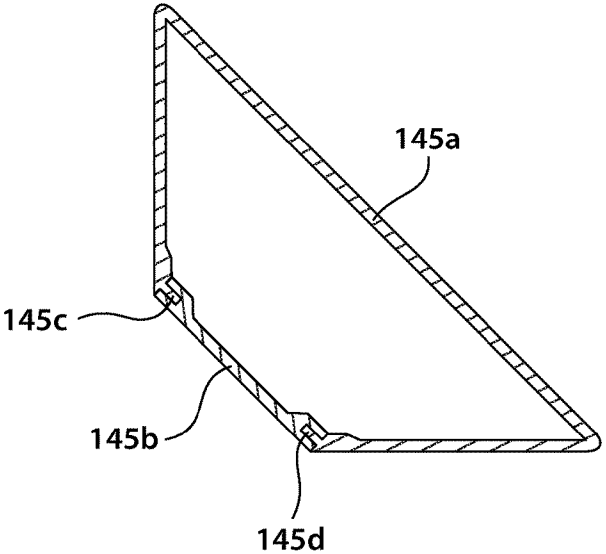
Figure 12B:
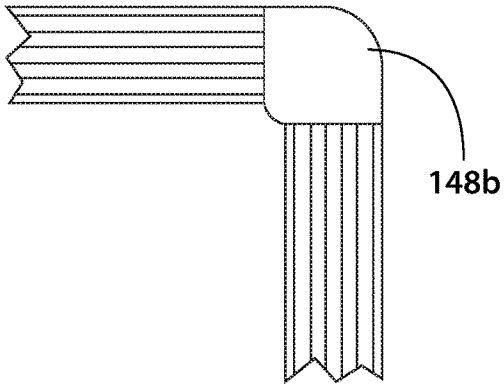
FIGS. 12A, 12B, and 12C illustrate top views of variations of a corner post.
Figure 12A:
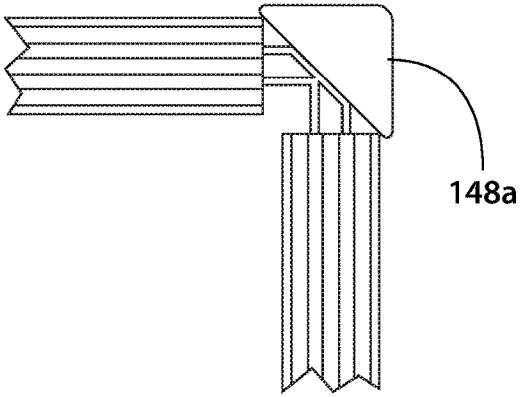
Figure 12C:
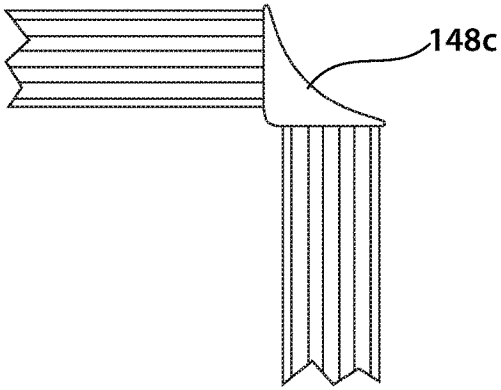
Figure 13:
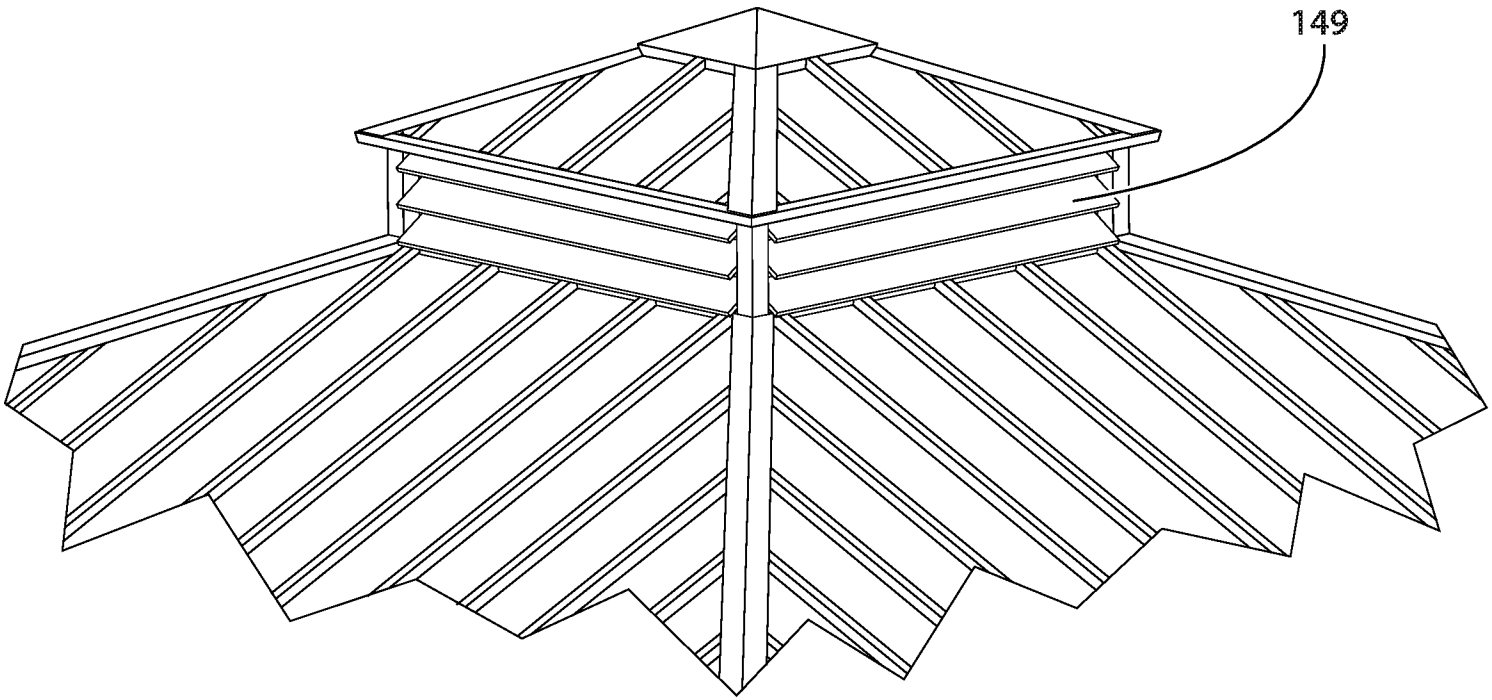
FIG. 13 illustrates a perspective view of a variation of a top roof with integrated louvers.
Figure 14:
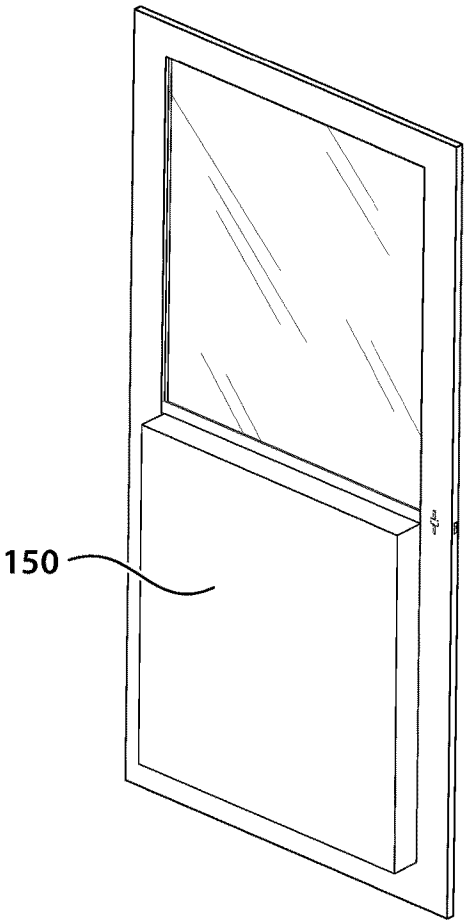
FIG. 14 illustrates a perspective view of an insulating panel being integrated to the second panel of the multi-purpose panel frames.

Any component of the four-device-in-one splash-and-drip-eliminating gazebo can have any shape and size. Any component of the four-device-in-one splash-and-drip-eliminating gazebo can be made of any material(s). FIGS. 10A and 10B illustrate top perspective views of variations of rain-water drain holes 138*a* and 138*b* in rain-water gutters 109. FIGS. 11A and 11B illustrate cross-sectional and top perspective views of a variation of a two-part triangular corner post 139*a* and 139*b* with sliding coupler joints 139*c* and 139*d*, and a rain-water-draining spout or an electrical connection box 140, which integrates an external electrical source 141 to the four-device-in-one splash-and-drip-eliminating gazebo. FIGS. 11C, and 11D illustrate cross-sectional and top perspective views of a variation of a two-part square corner post 142*a* and 142*b* with sliding coupler joints 142*c* and 142*d*, and a rain-water-draining spout or an electrical connection box 143, which integrates an external electrical source 144 to the four-device-in-one splash-and-drip-eliminating gazebo. FIGS. 11E, and 11F illustrate cross-sectional and top perspective views of a variation of a two-part triangular corner post 145*a* and 145*b* with sliding coupler joints 145*c* and 145*d*, and a rain-water-draining spout or an electrical connection box 146, which integrates an external electrical source 147 to the four-device-in-one splash-and-drip-eliminating gazebo. FIGS. 12A, 12B, and 12C illustrate top views of variations of corner post 116*a* as corner posts 148*a*, 148*b*, and 148*c*. FIG. 13 illustrates a top perspective view of a variation of top roof 102 with integrated louvers 149. FIG. 14 illustrates a top perspective view of insulating panel 150 being integrated to second panels 123 of multi-purpose panel frames 121.

Major Advantages of the Invention

The present invention substantially departs from the conventional concepts and designs of the prior art. In doing so, the present invention provides a a four-device-in-one splash-and-drip-eliminating gazebo having many new and significant features, functions, and advantages, which overcome all the disadvantages of the prior art, as follows:

1) It is an object of the new invention to provide a four-device-in-one splash-and-drip-eliminating gazebo, having
height-adjustable tube-screws 132 and
anchoring screws 134.
Therefore, the four-device-in-one splash-and-drip-eliminating gazebo:
a) Can securably insert into anchoring-screw holes 133
to provide vertical adjustability
(see FIGS. 2A and 9);
b) Can adjust the height of corner posts 116*a*
to compensate for uneven terrain
(see FIGS. 2A and 9);
c) Can adjust the height of corner posts 116*a*
to compensate for uneven concrete surface
(see FIGS. 2A and 9);
d) Can adjust the height of corner posts 116*a*
to compensate for uneven deck surface
(see FIGS. 2A and 9); and
e) Can level the gazebo
to keep water drainage working properly
(see FIGS. 2A and 9).

2) It is another object of the new invention to provide a four-device-in-one splash-and-drip-eliminating gazebo, having
multi-purpose panel frames 121.
Therefore, the four-device-in-one splash-and-drip-eliminating gazebo:
a) Can securably hold screen material first panels 122, screen material second panels 123, and H-shaped panel strips 124
to allow wind to flow through
(see FIG. 8I);
b) Can securably hold transparent material first panels 122, transparent material second panels 123, and H-shaped panel strips 124
to provide light to shine through
(see FIGS. 8A, 8B, 8C, 8D, 8E, 8F, 8G, 8J, and 8K);

c) Can securably hold opaque material first panels 122, opaque material second panels 123, and H-shaped panel strips 124
to block wind or light
(see FIG. 8H); and d) Can allow quick and easy installation of door panels
to provide numerous door configuration options
(see FIGS. 8A, 8B, 8C, 8D, 8E, 8F, 8G, 8H, 8I, 8J, and 8K).

3) It is another object of the new invention to provide a four-device-in-one splash-and-drip-eliminating gazebo, having
first panels 122.
Therefore, the four-device-in-one splash-and-drip-eliminating gazebo:

a) Can allow wind to flow through when made with mesh material
to cool occupants
(see FIG. 8I);

b) Can provide light to shine through when made with transparent material
to provide light to occupants
(see FIGS. 8A, 8B, 8C, 8D, 8E, 8F, 8G, 8J, and 8K); and c) Can block wind or light when made with solid material
to provide cooling and light to occupants
(see FIG. 8H).

4) It is a further object of the new invention to provide a four-device-in-one splash-and-drip-eliminating gazebo, having
second panels 123.
Therefore, the four-device-in-one splash-and-drip-eliminating gazebo:

a) Can allow wind to flow through when made with mesh material
to cool occupants
(see FIG. 8I);

b) Can provide light to shine though when made with transparent material
to provide light to occupants
(see FIGS. 8A, 8B, 8C, 8D, 8E, 8F, 8G, 8J, and 8K); and c) Can block wind or light when made with solid material
to provide cooling and light to occupants
(see FIGS. 1A and 8H).

5) It is an even further object of the new invention to provide a four-device-in-one splash-and-drip-eliminating gazebo, having
splash-drip-eliminating eaves 107.
Therefore, the four-device-in-one splash-and-drip-eliminating gazebo:

a) Can extend downward into the inside of rain-water gutters 109 and
Can direct water downward into the inside of rain-water gutters 109
in the directions of arrows 136*b* and 136*c*
to eliminate water splash and water drip
(see FIGS. 7F, 7G, 8G, and 8M);

a) Can collect rain water
to be used for irrigation
(see FIGS. 7F, 7G, 8G, and 8M); and b) Can protect occupants from getting wet
to keep them dry and safe
(see FIGS. 7F, 7G, 8G, and 8M).

6) It is another object of the new invention to provide a four-device-in-one splash-and-drip-eliminating gazebo, having
rain-water gutters 109 and
top rails 114 extrudedly manufactured as one unit to reinforce one another and to function as gutters and top rails at the same time.
Therefore, the four-device-in-one splash-and-drip-eliminating gazebo:

a) Can direct water into rain-water drain holes 110
in the directions of arrows 137*a* and 137*b*
to direct water away from gazebo
(see FIGS. 7E, 7F, 7G, and 7H);

b) Can collect rain water
to be used for irrigation
(see FIGS. 7E, 7F, 7G, and 7H); and c) Can direct water away from occupants
to keep them dry and safe
(see FIGS. 7E, 7F, 7G, and 7H).

7) It is yet another object of the new invention to provide a four-device-in-one splash-and-drip-eliminating gazebo, having
rain-water drain holes 110.
Therefore, the four-device-in-one splash-and-drip-eliminating gazebo:

a) Can prevent leaves or other debris from getting into leaf-filtering tubes 111
to keep leaf-filtering tubes 111 free from clogs
(see FIGS. 7A, 7C, 7D, 7E, 7G, and 7H);

b) Can prevent small birds or animals from entering or nesting inside leaf-filtering tubes 111
to keep leaf-filtering tubes 111 free from clogs
(see FIGS. 7A, 7C, 7D, 7E, 7G, and 7H); and c) Can collect rain water
to be used for irrigation
(see FIGS. 7A, 7C, 7D, 7E, 7G, and 7H).

8) It is still yet another object of the new invention to provide a four-device-in-one splash-and-drip-eliminating gazebo, having
leaf-filtering tubes 111 and rain-water-draining spouts 112 hidden inside corner posts 116*a*.
Therefore, the four-device-in-one splash-and-drip-eliminating gazebo:

a) Can filter leaves and draining water from inside corner posts 116*a*
in the directions of arrows 136*c* and 137*b*
to separate the leaves from the water
(see FIGS. 7G and 7H);

b) Can direct water quickly and safely away from the gazebo from inside corner posts 116*a*
to prevent rusting and wear
in the directions of arrows 136*c* and 137*b*
(see FIGS. 7G and 7H); and c) Can directing water quickly and safely away from occupants from inside corner posts 116*a*
to keep them safe and dry
in the directions of arrows 136*c* and 137*b*
(see FIGS. 7G and 7H).

9) It is still yet another object of the new invention to provide a four-device-in-one splash-and-drip-eliminating gazebo, having
post-locking top-rail slots 115.
Therefore, the four-device-in-one splash-and-drip-eliminating gazebo:

a) Can securely fasten corner posts 116*a* to top rails 114
to keep gazebo from coming apart and injuring occupants
(see FIGS. 7A, 7D, and 7E);

b) Can automatically guide corner posts 116*a* easily into top-rail-locking post slots 117 to make assembly easier (see FIGS. 7A, 7D, and 7E); and c) Can keep corners and posts plumb to prevent gazebo from twisting (see FIGS. 7A, 7D, and 7E).

10) It is still yet another object of the new invention to provide a four-device-in-one splash-and-drip-eliminating gazebo, having top-rail-locking post slots 117.

Therefore, the four-device-in-one splash-and-drip-eliminating gazebo:

a) Can securely fasten top rails 114 to corner posts 116*a* to prevent the gazebo from collapsing (see FIGS. 7B, 7C, and 7F);

b) Can automatically guide corner posts 116*a* easily into post-locking top-rail slots 115 to make assembly easier (see FIGS. 7A, 7D, and 7E); and c) Can keeping corner posts 116*a* plumb to prevent gazebo from twisting (see FIGS. 7A, 7D, and 7E).

11) It is still yet another object of the new invention to provide a four-device-in-one splash-and-drip-eliminating gazebo, having double-U-shaped-end covers 116*b*.

Therefore, the four-device-in-one splash-and-drip-eliminating gazebo:

a) Can slide on and off corner posts 116*a* to allow access to the inside of corner posts 116*a* (see FIGS. 11A, 11B, 11C, 11D, 11E, and 11F);

b) Can slide on and off corner posts 116*a* to allow the installation of electrical connection box 140 on the inside of corner posts 116*a* (see FIGS. 11A, 11B, 11C, 11D, 11E, and 11F); and c) Can slide on and off corner posts 116*a* to integrate an external electrical source 141 on the inside of corner posts 116*a* to supply electricity to the four-device-in-one splash-and-drip-eliminating gazebo from the inside of corner posts 116*a* (see FIGS. 11A, 11B, 11C, 11D, 11E, and 11F).

What is claimed is:

1. A four-device-in-one splash-and-drip-eliminating gazebo comprising:

a top roof;

a plurality of top-roof columns
respectively screwed to said top roof
for strengthening and supporting said top roof;

a plurality of top-roof mosquito-mesh panels
respectively screwed to said top-roof columns
for allowing ventilation and wind-flow and
for keeping mosquitoes out of said four-device-in-one splash-and-drip-eliminating gazebo;

a bottom roof,
said bottom roof having a bottom-roof end,
said bottom roof respectively screwed to said top-roof columns
for protectively shedding water away from said four-device-in-one splash-and-drip-eliminating gazebo;

a plurality of rain-water gutters,
said rain-water gutters having a gutter inside,
said rain-water gutters
for collecting rain water
to be used for irrigation, and
for directing water away from occupants
to keep them dry and safe;

a plurality of splash-drip-eliminating eaves
respectively formed at said bottom-roof end of said bottom roof
for extending downward into said gutter inside of said rain-water gutters
to direct water downward into said gutter inside of rain-water gutters
to eliminate water splash and water drip,
for collecting rain water
to be used for irrigation, and
for keeping occupants dry and safe;

a plurality of top rails
molded to said rain-water gutters as one unit
for functioning as gutters and top rails at the same time,
said bottom roof screwed to said rain-water gutters and said top rails;

a plurality of corner posts,
said corner posts having a corner-post inside and a corner-post outside,
said corner posts respectively attached to said rain-water gutters and said top rails;

a plurality of double-U-shaped-end covers
respectively slidably coupled with said corner posts
for allowing access to said corner-post inside,
for allowing the installation of electrical components on said corner-post inside,
for allowing the supply of electricity to said four-device-in-one splash-and-drip-eliminating gazebo from said corner-post inside, and
for removably covering and protecting electrical components on said corner-post inside;

a plurality of post-locking top-rail slots
respectively molded into said top rails
for lockably fastening said corner posts to said top rails
to keep said four-device-in-one splash-and-drip-eliminating gazebo from coming apart,
for automatically guiding said corner posts into said post-locking top-rail slots
to make assembly easier, and
for keeping said corner posts plumb
to prevent said four-device-in-one splash-and-drip-eliminating gazebo from twisting;

a plurality of top-rail-locking post slots
respectively molded into said corner posts,
said post-locking top-rail slots respectively inserted into said top-rail-locking post slots,
said top-rail-locking post slots
for providing openings for said top rails to enter and secure therein
to prevent said four-device-in-one splash-and-drip-eliminating gazebo from collapsing,
for automatically guiding said top rails into said top-rail-locking post slots
to make assembly easier, and
for keeping said corner posts plumb
to prevent said four-device-in-one splash-and-drip-eliminating gazebo from twisting;

a plurality of bottom rails;

a plurality of bottom-rail brackets
respectively screwed into said corner posts,
said bottom rails respectively screwed into said bottom-rail brackets
for securably connecting said bottom rails to said corner posts;

a plurality of multi-purpose door frames
slidably placed between said top rails and said bottom rails;

a plurality of first panels
respectively secured to said multi-purpose door frames
for allowing wind to flow therethrough, and
for providing light to shine therethrough;
a plurality of second panels
respectively secured to said multi-purpose door frames
for allowing wind to flow therethrough, and
for providing light to shine therethrough;
a plurality of H-shaped panel strips
respectively secured between said first panels and said second panels
for stabilizing said first panels and said second panels;
a plurality of slide-lock catches
respectively attached to said multi-purpose door frames
for latching and unlatching said multi-purpose door frames to and from one another;
an inner post
insertably screwed to said corner posts;
a base
welded to said inner post
for providing stability for said four-device-in-one splash-and-drip-eliminating gazebo;
a plurality of base holes
respectively molded into said base;
a plurality of height-adjustable tube-screws
respectively and securably screwed into said base holes
for adjusting the height of said corner posts
to compensate for uneven terrain,
for adjusting the height of said corner posts
to compensate for uneven concrete surface,
for adjusting the height of said corner posts
to compensate for uneven deck surface, and
for leveling said four-device-in-one splash-and-drip-eliminating gazebo
to keep water drainage working properly;
a plurality of anchoring-screw holes
respectively molded into said height-adjustable tube-screws; and
a plurality of anchoring screws
respectively screwed into said anchoring-screw holes in said height-adjustable tube-screws
for securing and strengthening said triangular base and said four-device-in-one splash-and-drip-eliminating gazebo to the ground.

2. The four-device-in-one splash-and-drip-eliminating gazebo of claim 1,
further comprising
a plurality of rain-water drain holes,
a plurality of leaf-filtering tubes,
a plurality of rain-water-draining spouts, and
a plurality of rain-water-draining spout holes,
wherein
said rain-water drain holes
have a hole bottom and
respectively are formed into said top rails
for draining water away from said four-device-in-one splash-and-drip-eliminating gazebo
to prevent rusting,
for straining leaves or other debris from getting into said leaf-filtering tubes
to keep said leaf-filtering tubes free from clogs,
for preventing small birds or animals from entering or nesting inside said leaf-filtering tubes
to keep said leaf-filtering tubes free from clogs, and
for collecting rain water
to be used for irrigation,
wherein
said leaf-filtering tubes
have a tube bottom,
respectively are disposed inside said corner posts and
respectively are friction-fit to said hole bottom of said rain-water drain holes and
for filtering leaves and draining water,
for directing water quickly and safely away from said gazebo
to prevent rusting and wear, and
for directing rain water quickly and safely away from occupants
to keep them safe and dry,
wherein
said rain-water-draining spouts
respectively are disposed inside said corner posts and
respectively are friction-fit to said tube bottom of said leaf-filtering tubes
for directing water into said rain-water-draining spout holes
said rain-water-draining spout holes
respectively are drilled through said corner posts
for extending said rain-water-draining spouts from said corner-post inside
to said corner-post outside
to drain water away from said four-device-in-one splash-and-drip-eliminating gazebo.

3. The four-device-in-one splash-and-drip-eliminating gazebo of claim 2,
wherein
said leaf-filtering tubes
each are formed into a tubular shape and
are made of plastic or rubber material.

4. The four-device-in-one splash-and-drip-eliminating gazebo of claim 1,
wherein
said post-locking top-rail slots and
said top-rail-locking post slots
each are formed into a rectangular shape.

5. The four-device-in-one splash-and-drip-eliminating gazebo of claim 1,
wherein
said double-U-shaped-end covers
each are formed into a double-U-shaped cross-section and
are made of metallic material.

6. The four-device-in-one splash-and-drip-eliminating gazebo of claim 1,
wherein
said first panels
each are formed into a rectangular shape and
are made of mesh material, transparent material, or solid material.

7. The four-device-in-one splash-and-drip-eliminating gazebo of claim 1,
wherein
said second panels
each are formed into a rectangular shape, and
are made of mesh material, transparent material, or solid material.

8. The four-device-in-one splash-and-drip-eliminating gazebo of claim 1,
wherein
said rain-water gutters and
said top rails
are formed into an extrudedly-molded-together C-and-E shape and
are made of metallic material.

9. The four-device-in-one splash-and-drip-eliminating gazebo of claim 1, wherein said four-device-in-one splash-and-drip-eliminating gazebo is partially or entirely made of a material selected from the group consisting of: plastic, metal, mesh, rubber, and a combination of at least two of said above-mentioned materials.

10. A four-device-in-one gazebo comprising:

a top roof;

a plurality of roof columns respectively screwed to said top roof for strengthening and supporting said top roof;

a plurality of top-roof mosquito-mesh panels respectively screwed to said roof columns for allowing ventilation and wind-flow and for keeping mosquitoes out of said four-device-in-one splash-and-drip-eliminating gazebo;

a bottom roof, said bottom roof having a bottom-roof end, said bottom roof respectively screwed to said roof columns for protectively shedding water away from said four-device-in-one splash-and-drip-eliminating gazebo;

a plurality of gutters, said gutters having a gutter inside, said gutters for collecting rain water to be used for irrigation, and for directing water away from occupants to keep them dry and safe;

a plurality of splash-drip-eliminating eaves respectively formed at said bottom-roof end of said bottom roof for extending downward into said gutter inside of said gutters to direct water downward into said gutter inside of gutters to eliminate water splash and water drip, for collecting rain water to be used for irrigation, and for keeping occupants dry and safe;

a plurality of top rails molded to said gutters as one unit for functioning as gutters and top rails at the same time, said bottom roof screwed to said gutters and said top rails;

a plurality of corner posts, said corner posts having a corner-post inside and a corner-post outside, said corner posts respectively attached to said gutters and said top rails;

a plurality of double-U-shaped-end covers respectively slidably coupled with said corner posts for allowing access to said corner-post inside, for allowing the installation of electrical components on said corner-post inside, for allowing the supply of electricity to said four-device-in-one splash-and-drip-eliminating gazebo, and for removably covering and protecting electrical components on said corner-post inside;

a plurality of post-locking top-rail slots respectively molded into said top rails for lockably fastening said corner posts to said top rails to keep said four-device-in-one splash-and-drip-eliminating gazebo from coming apart, for automatically guiding said corner posts into said post-locking top-rail slots to make assembly easier, and for keeping said corner posts plumb to prevent said four-device-in-one splash-and-drip-eliminating gazebo from twisting;

a plurality of top-rail-locking post slots respectively molded into said corner posts, said post-locking top-rail slots respectively inserted into said top-rail-locking post slots, said top-rail-locking post slots for providing openings for said top rails to enter and secure therein to prevent said four-device-in-one splash-and-drip-eliminating gazebo from collapsing, for automatically guiding said top rails into said top-rail-locking post slots to make assembly easier, and for keeping said corner posts plumb to prevent said four-device-in-one splash-and-drip-eliminating gazebo from twisting;

a plurality of bottom rails;

a plurality of bottom-rail brackets respectively screwed into said corner posts, said bottom rails respectively screwed into said bottom-rail brackets for securably connecting said bottom rails to said corner posts;

a plurality of multi-purpose door frames slidably placed between said top rails and said bottom rails;

a plurality of panels respectively secured to said multi-purpose door frames for allowing wind to flow therethrough, and for providing light to shine therethrough;

a plurality of H-shaped panel strips respectively secured between said panels;

a plurality of slide-lock catches respectively attached to said multi-purpose door frames for latching and unlatching said multi-purpose door frames to and from one another;

an inner post insertably screwed to said corner posts;

a base welded to said inner post for providing stability for said four-device-in-one splash-and-drip-eliminating gazebo;

a plurality of base holes respectively molded into said base;

a plurality of height-adjustable tube-screws respectively and securably screwed into said base holes for adjusting the height of said corner posts to compensate for uneven terrain, for adjusting the height of said corner posts to compensate for uneven concrete surface, for adjusting the height of said corner posts to compensate for uneven deck surface, and for leveling said four-device-in-one splash-and-drip-eliminating gazebo to keep water drainage working properly;

a plurality of anchoring-screw holes respectively molded into said height-adjustable tube-screws; and a plurality of anchoring screws respectively screwed into said anchoring-screw holes in said height-adjustable tube-screws for securing and strengthening said triangular base and said four-device-in-one splash-and-drip-eliminating gazebo to the ground.

11. The four-device-in-one gazebo of claim 10,
further comprising
a plurality of rain-water drain holes,
a plurality of leaf-filtering tubes,
a plurality of rain-water-draining spouts, and
a plurality of rain-water-draining spout holes,
wherein
said rain-water drain holes
have a hole bottom and
respectively are formed into said top rails
for draining water away from said four-device-in-one gazebo
to prevent rusting,
for straining leaves or other debris from getting into said leaf-filtering tubes
to keep said leaf-filtering tubes free from clogs,
for preventing small birds or animals from entering or nesting inside said leaf-filtering tubes
to keep said leaf-filtering tubes free from clogs, and
for collecting rain water
to be used for irrigation,
wherein
said leaf-filtering tubes
have a tube bottom,
respectively are disposed inside said corner posts and
respectively are friction-fit to said hole bottom of said rain-water drain holes and
for filtering leaves and draining water,
for directing water quickly and safely away from said gazebo
to prevent rusting and wear, and
for directing rain water quickly and safely away from occupants
to keep them safe and dry,
wherein
said rain-water-draining spouts
respectively are disposed inside said corner posts and
respectively are friction-fit to said tube bottom of said leaf-filtering tubes
for directing water into said rain-water-draining spout holes
said rain-water-draining spout holes
respectively are drilled through said corner posts
for extending said rain-water-draining spouts from said corner-post inside
to said corner-post outside
to drain water away from said four-device-in-one gazebo.

12. The four-device-in-one splash-and-drip-eliminating gazebo of claim 11,
wherein
said leaf-filtering tubes
each are formed into a tubular shape and
are made of plastic or rubber material.

13. The four-device-in-one gazebo of claim 10,
wherein
said post-locking toprail slots and
said toprail-locking post slots
each are formed into a rectangular shape.

14. The four-device-in-one gazebo of claim 10,
wherein
said double-U-shaped-end covers
each are formed into a double-U-shaped cross-section and
are made of metallic material.

15. The four-device-in-one gazebo of claim 10,
wherein
said panels
each are formed into a rectangular shape.

16. The four-device-in-one gazebo of claim 10,
wherein
said panels
each are made of mesh material, transparent material, or solid material.

17. The four-device-in-one gazebo of claim 10,
wherein
said gutters and
said top rails
are formed into an extrudedly-molded-together C-and-E shape and
are made of metallic material.

18. The four-device-in-one gazebo of claim 10,
wherein
said four-device-in-one gazebo
is partially or entirely made of a material selected from the group consisting of: plastic, metal, mesh, rubber, and a combination of at least two of said above-mentioned materials.

19. A four-device-in-one gazebo comprising:
a top roof;
a plurality of roof columns
respectively screwed to said top roof
for strengthening and supporting said top roof;
a plurality of top-roof mosquito-mesh panels
respectively screwed to said roof columns
for allowing ventilation and wind-flow and
for keeping mosquitoes out of said four-device-in-one splash-and-drip-eliminating gazebo;
a bottom roof,
said bottom roof having a bottom-roof end,
said bottom roof respectively screwed to said roof columns
for protectively shedding water away from said four-device-in-one splash-and-drip-eliminating gazebo;
a plurality of gutters,
said gutters having a gutter inside,
said gutters
for collecting rain water
to be used for irrigation, and
for directing water away from occupants
to keep them dry and safe;
a plurality of splash-drip-eliminating eaves
respectively formed at said bottom-roof end of said bottom roof
for extending downward into said gutter inside of said gutters
to direct water downward into said gutter inside of gutters
to eliminate water splash and water drip,
for collecting rain water
to be used for irrigation, and
for keeping occupants dry and safe;
a plurality of top rails
molded to said gutters as one unit
for functioning as gutters and top rails at the same time,
said bottom roof screwed to said gutters and said top rails;
a plurality of corner posts,
said corner posts having a corner-post inside and a corner-post outside,
said corner posts respectively attached to said gutters and said top rails;

a plurality of double-U-shaped-end covers
respectively slidably coupled with said corner posts
for allowing access to said corner-post inside,
for allowing the installation of electrical components on said corner-post inside,
for allowing the supply of electricity to said four-device-in-one splash-and-drip-eliminating gazebo, and
for removably covering and protecting electrical components on said corner-post inside;
a plurality of post-locking top-rail slots
respectively molded into said top rails
for lockably fastening said corner posts to said top rails
to keep said four-device-in-one splash-and-drip-eliminating gazebo from coming apart,
for automatically guiding said corner posts into said post-locking toprail slots
to make assembly easier, and
for keeping said corner posts plumb
to prevent said four-device-in-one splash-and-drip-eliminating gazebo from twisting;
a plurality of top-rail-locking post slots
respectively molded into said corner posts,
said post-locking top-rail slots respectively inserted into said top-rail-locking post slots,
said top-rail-locking post slots
for providing openings for said top rails to enter and secure therein
to prevent said four-device-in-one splash-and-drip-eliminating gazebo from collapsing,
for automatically guiding said top rails into said top-rail-locking post slots
to make assembly easier, and
for keeping said corner posts plumb
to prevent said four-device-in-one splash-and-drip-eliminating gazebo from twisting;
a plurality of bottom rails;
a plurality of bottom-rail brackets
respectively screwed into said corner posts,
said bottom rails respectively screwed into said bottom-rail brackets
for securably connecting said bottom rails to said corner posts;
a plurality of multi-purpose door frames
slidably placed between said top rails and said bottom rails;
a plurality of panels
respectively secured to said multi-purpose door frames
for allowing wind to flow therethrough, and
for providing light to shine therethrough;
an inner post
insertably screwed to said corner posts;
a base
welded to said inner post
for providing stability for said four-device-in-one splash-and-drip-eliminating gazebo;
a plurality of base holes
respectively molded into said base;
a plurality of height-adjustable tube-screws
respectively and securably screwed into said base holes
for adjusting the height of said corner posts
to compensate for uneven terrain,
for adjusting the height of said corner posts
to compensate for uneven concrete surface,
for adjusting the height of said corner posts
to compensate for uneven deck surface, and
for leveling said four-device-in-one splash-and-drip-eliminating gazebo
to keep water drainage working properly;
a plurality of anchoring-screw holes
respectively molded into said height-adjustable tube-screws; and
a plurality of anchoring screws
respectively screwed into said anchoring-screw holes in said height-adjustable tube-screws
for securing and strengthening said triangular base and said four-device-in-one splash-and-drip-eliminating gazebo to the ground.

20. The four-device-in-one gazebo of claim 19,
further comprising
a plurality of rain-water drain holes,
a plurality of leaf-filtering tubes,
a plurality of rain-water-draining spouts, and
a plurality of rain-water-draining spout holes,
wherein
said rain-water drain holes
have a hole bottom and
respectively are formed into said top rails
for draining water away from said four-device-in-one gazebo
to prevent rusting,
for straining leaves or other debris from getting into said leaf-filtering tubes
to keep said leaf-filtering tubes free from clogs,
for preventing small birds or animals from entering or nesting inside said leaf-filtering tubes
to keep said leaf-filtering tubes free from clogs, and
for collecting rain water
to be used for irrigation,
wherein
said leaf-filtering tubes
have a tube bottom,
respectively are disposed inside said corner posts and
respectively are friction-fit to said hole bottom of said rain-water drain holes and
for filtering leaves and draining water,
for directing water quickly and safely away from said gazebo
to prevent rusting and wear, and
for directing rain water quickly and safely away from occupants
to keep them safe and dry,
wherein
said rain-water-draining spouts
respectively are disposed inside said corner posts and
respectively are friction-fit to said tube bottom of said leaf-filtering tubes
for directing water into said rain-water-draining spout holes
said rain-water-draining spout holes
respectively are drilled through said corner posts
for extending said rain-water-draining spouts from said corner-post inside
to said corner-post outside
to drain water away from said four-device-in-one gazebo.

* * * * *